US009309734B2

(12) United States Patent
Richards et al.

(10) Patent No.: US 9,309,734 B2
(45) **Date of Patent: *Apr. 12, 2016**

(54) MULTI-POSITION WEIGHT DOWN LOCATING TOOL

(71) Applicant: HALLIBURTON ENERGY SERVICES, INC., Houston, TX (US)

(72) Inventors: William Mark Richards, Flower Mound, TX (US); Thomas Jules Frosell, Irving, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 160 days.

This patent is subject to a terminal disclaimer.

(21) Appl. No.: 14/056,635

(22) Filed: Oct. 17, 2013

(65) Prior Publication Data

US 2014/0166312 A1 Jun. 19, 2014

Related U.S. Application Data

(63) Continuation of application No. PCT/US2012/070203, filed on Dec. 17, 2012.

(51) Int. Cl.

| | |
|---|---|
| ***E21B 23/02*** | (2006.01) |
| ***E21B 43/10*** | (2006.01) |
| ***E21B 47/09*** | (2012.01) |
| ***E21B 23/01*** | (2006.01) |

(52) U.S. Cl.

CPC ..... *E21B 23/01* (2013.01); *E21B 23/02* (2013.01); *E21B 43/10* (2013.01); *E21B 47/09* (2013.01)

(58) Field of Classification Search

CPC ..... E21B 23/02; E21B 47/09; E21B 43/10

See application file for complete search history.

(56) References Cited

U.S. PATENT DOCUMENTS

| | | | |
|---|---|---|---|
| 3,207,222 | A | 9/1965 | Tamplen |
| 3,446,281 | A | 5/1969 | Watkins |
| 4,437,522 | A | 3/1984 | Krause et al. |
| 4,440,233 | A | 4/1984 | Baugh et al. |

(Continued)

FOREIGN PATENT DOCUMENTS

WO 2014098797 A1 6/2014

OTHER PUBLICATIONS

Notice of Allowance dated Apr. 17, 2014, filed Oct. 17, 2013, U.S. Appl. No. 14/112,465.

(Continued)

*Primary Examiner* — Giovanna C Wright

(74) *Attorney, Agent, or Firm* — Scott Richardson; Baker Botts L.L.P.

(57) ABSTRACT

A weight down tool comprises a central mandrel configured to be coupled to a wellbore tubular, an outwardly extending indicator disposed about the central mandrel, and a plurality of radially expandable weight down lugs configured to engage a lower restriction and prevent downwards movement of the central mandrel with respect to the lower restriction when disposed in an expanded position. The indicator is configured to retract inwards in response to moving through an upper restriction in a downwards direction to expand the weight down lugs into the expanded position in response to moving through the lower restriction in an upwards direction. The weight down lugs are configured to retract out of the expanded position in response to moving through the upper restriction in an upwards direction.

12 Claims, 9 Drawing Sheets

(56) References Cited

U.S. PATENT DOCUMENTS

| | | | | |
|---|---|---|---|---|
| 4,595,054 | A | 6/1986 | Schroeder | |
| 4,722,392 | A | 2/1988 | Proctor et al. | |
| 4,745,973 | A | 5/1988 | Semar | |
| 4,745,974 | A | 5/1988 | Higgins | |
| 4,832,129 | A | 5/1989 | Sproul et al. | |
| 5,348,087 | A | 9/1994 | Williamson, Jr. | |
| 5,549,161 | A | 8/1996 | Gomez et al. | |
| 5,727,632 | A | 3/1998 | Richards | |
| 5,921,318 | A | 7/1999 | Ross | |
| 6,009,941 | A | 1/2000 | Haynes | |
| 6,382,319 | B1 | 5/2002 | Hill, Jr. et al. | |
| 6,823,938 | B1 | 11/2004 | Milberger | |
| 7,523,787 | B2 | 4/2009 | Richards et al. | |
| 7,721,810 | B2 | 5/2010 | Weirich | |
| 7,931,085 | B2 | 4/2011 | Moyes | |
| 8,789,588 | B2 * | 7/2014 | Richards et al. | 166/255.1 |
| 2004/0238185 | A1 | 12/2004 | Rothers et al. | |
| 2011/0132599 | A1 | 6/2011 | Xu | |
| 2014/0158348 | A1 | 6/2014 | Richards et al. | |
| 2014/0166311 | A1 | 6/2014 | Richards et al. | |

OTHER PUBLICATIONS

Richards, William Mark, Patent Application entitled "Multi-Position Weight Down Locating Tool", filed Oct. 17, 2013, U.S. Appl. No. 14/112,465.

Richards, William Mark, Patent Application entitled "Multi-Position Weight Down Locating Tool", filed Oct. 17, 2013, U.S. Appl. No. 14/056,623.

FAIPP Pre-Communication dated Mar. 21, 2014, filed Oct. 17, 2013, U.S. Appl. No. 14/112,465.

Foreign Communication from a Related Counterpart Application, "International Search Report and Written Opinion" dated Sep. 6, 2013. International Application No. PCT/US12/70203 filed on Dec. 17, 2012.

International Preliminary Report on Patentability issued in related PCT Application No. PCT/US2012/070203, mailed Jul. 2, 2015 (7 pages).

* cited by examiner

MULTI-POSITION WEIGHT DOWN LOCATING TOOL

CROSS-REFERENCE TO RELATED APPLICATIONS

This application is a continuation of and claims priority under 35 U.S.C. §120 to International Patent Application Serial No. PCT/US12/70203, filed on Dec. 17, 2012, entitled "Multi-Position Weight Down Locating Tool," by William Mark Richards, et al., which is incorporated herein by reference for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In the course of completing an oil and/or gas well, a string of protective casing can be run into the wellbore followed by production tubing inside the casing. The casing can be perforated across one or more production zones to allow production fluids to enter the casing bore. During production of the formation fluid, formation sand may be swept into the flow path. The formation sand tends to be relatively fine sand that can erode production components in the flow path. In some completions, the wellbore is uncased, and an open face is established across the oil or gas bearing zone. Such open bore hole (uncased) arrangements are typically utilized, for example, in water wells, test wells, and horizontal well completions.

When formation sand is expected to be encountered, one or more sand screens can be installed in the flow path between the production tubing and the perforated casing (cased) and/or the open well bore face (uncased). A packer is customarily set above the sand screen to seal off the annulus in the zone where production fluids flow into the production tubing. The annulus around the screen can then be fractured and/or packed with a relatively coarse sand (or gravel) which acts as a filter to reduce the amount of fine formation sand reaching the screen. The packing sand is pumped down the work string in a slurry of water and/or gel and fills the annulus between the sand screen and the well casing. In well installations in which the screen is suspended in an uncased open bore, the sand or gravel pack may serve to support the surrounding unconsolidated formation.

Various workover assemblies can be used in the performance of the sand packing process. The weight of the workover assembly is generally supported at or near the zone being fractured and/or packed with sand. When multiple zones are being treated, the workover assembly may be used to treat one zone and then moved to treat the next zone. In addition, various subsequent procedures may be performed before, during, and/or after the fracturing and/or sand packing process in order to complete the wellbore. Each of these procedures may use a workover assembly that may be supported at or near the zone of interest.

SUMMARY

In an embodiment, a weight down system comprises a wellbore comprising a plurality of restrictions; and a weight down tool. The weight down tool comprises a central mandrel configured to be coupled to a wellbore tubular; an outwardly extending indicator disposed about the central mandrel, wherein the indicator is configured to retract inwards in response to moving through one or more of the plurality of restrictions in a downwards direction; and a plurality of radially expandable weight down lugs configured to selectively transition between an expanded position and a retracted position. The indicator is configured to expand the weight down lugs into the expanded position in response to moving through one or more restrictions of the plurality of restrictions in an upwards direction, and the weight down lugs are configured to retract to the refracted position in response to the weight down lugs moving through one or more restrictions of the plurality of restrictions in an upwards direction. The weight down lugs may be configured to engage one of the plurality of restrictions and prevent downwards movement of the central mandrel with respect to the restriction when the weight down lugs are disposed in the expanded position In an embodiment, a method of applying weight to a restriction in a wellbore comprises raising an outwardly extending indicator disposed about a central mandrel into a restriction, where the restriction is formed on an inner surface of an outer wellbore tubular; expanding a plurality of weight down lugs from a refracted position to an expanded position in response to raising the indicator into the restriction, where the plurality of weight down lugs are configured to resist an axially and upwards directed force in the expanded position; transferring weight from the central mandrel to the outer wellbore tubular using the plurality of weight down lugs in the expanded position; applying an axially and downwardly directed force to the plurality of weight down lugs in the expanded position; and retracting the weight down lugs from the expanded position to the refracted position in response to applying the axially and downwardly directed force.

In an embodiment, a method of treating multi-zone wellbore comprises locating a weight down tool comprising a central mandrel within an outer wellbore tubular string; where the outer wellbore tubular string comprises a plurality of interior restrictions, and the plurality of interior restrictions comprise an upper restriction, and intermediate restriction, and a lower restriction; raising an outwardly extending indicator disposed about the central mandrel into at least one of the intermediate restriction or the lower restriction; expanding a plurality of weight down lugs from a refracted position to an expanded position in response to raising the indicator; engaging the plurality of weight down lugs with the lower restriction; transferring weight from the central mandrel to the lower restriction using the plurality of weight down lugs; and treating a first zone in the wellbore when the weight down lugs are engaged with the lower restriction.

In an embodiment, a weight down tool comprises a central mandrel configured to be coupled to a wellbore tubular; a plurality of outwardly extending hunter lugs disposed about the central mandrel, wherein the hunter lugs are configured to retract in response to moving through an upper restriction in a downwards direction; and a plurality of radially expandable weight down lugs disposed about the central mandrel. The hunter lugs are configured to expand the weight down lugs into an expanded position in response to moving through the upper restriction in an upwards direction, and the weight down lugs are configured to retract out of the expanded position in response to moving through the upper restriction in an upwards direction.

In an embodiment, a weight down tool comprises a central mandrel configured to be coupled to a wellbore tubular; a setting sleeve slidably disposed about the central mandrel, wherein the setting sleeve comprises a first end and a second end; a plurality of radially expandable hunter lugs retained by the setting sleeve; a weight down sleeve slidably disposed about the central mandrel; and a plurality of radially expandable weight down lugs retained by the weight down sleeve. The second end of the setting sleeve is configured to selectively shift into radial alignment with the weight down lugs and expand the weight down lugs into an expanded position in response to the plurality of hunter lugs moving upwards through a restriction, and the plurality of weight down lugs are configured to retract out of the expanded position in response to the plurality of weight down lugs moving through the restriction in an upwards direction.

In an embodiment, a method of applying weight to a restriction in a wellbore comprises raising a setting sleeve disposed about a central mandrel through an upper restriction in a wellbore; expanding a plurality of weight down lugs from a retracted position to an expanded position in response to raising the setting sleeve though the upper restriction, where the plurality of weight down lugs are disposed about the central mandrel; engaging the plurality of weight down lugs with a lower restriction in the wellbore; applying weight to the lower restriction using the plurality of weight down lugs; raising the setting sleeve through the upper restriction; raising the plurality of weight down lugs into the upper restriction; and refracting the weight down lugs out of the expanded position in response to raising the setting sleeve through the upper restriction and raising the plurality of weight down lugs into the upper restriction.

In an embodiment, a weight down tool comprises a central mandrel configured to be coupled to a wellbore tubular; an outwardly extending indicator disposed about the central mandrel, wherein the indicator is configured to retract inwards in response to moving through an upper restriction in a downwards direction; and a plurality of radially expandable weight down lugs configured to engage a lower restriction and prevent downwards movement of the central mandrel with respect to the lower restriction when disposed in an expanded position. The indicator is configured to expand the weight down lugs into the expanded position in response to moving through the lower restriction in an upwards direction, and the weight down lugs are configured to retract out of the expanded position in response to moving through the upper restriction in an upwards direction. The indicator may comprise a keyed profile.

In an embodiment, a weight down tool comprises a central mandrel configured to be coupled to a wellbore tubular; an upper housing slidably disposed about the central mandrel; an indicator sleeve slidably disposed about the central mandrel; an outwardly extendable and inwardly collapsible indicator disposed on the indicator sleeve; and a plurality of radially expandable weight down lugs retained by the upper housing. The indicator sleeve is configured to selectively expand the weight down lugs into an expanded position in response to the indicator moving upwards through a first restriction; and the plurality of weight down lugs are configured to retract out of the expanded position in response to the plurality of weight down lugs moving through a second restriction in an upwards direction, where the second restriction is above the first restriction.

In an embodiment, a method of applying weight to a restriction in a wellbore comprises engaging an indicator disposed on an indicator sleeve with a first restriction in a wellbore, wherein the indicator sleeve is disposed about a central mandrel; raising the central mandrel relative to the indicator sleeve; expanding a plurality of weight down lugs into an expanded position in response to raising the central mandrel relative to the indicator sleeve; lowering the plurality of weight down lugs into engagement with the first restriction; and applying weight to the first restriction using the plurality of weight down lugs. The indicator may comprise a keyed profile, and the first restriction may comprise a profile corresponding to the keyed profile.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
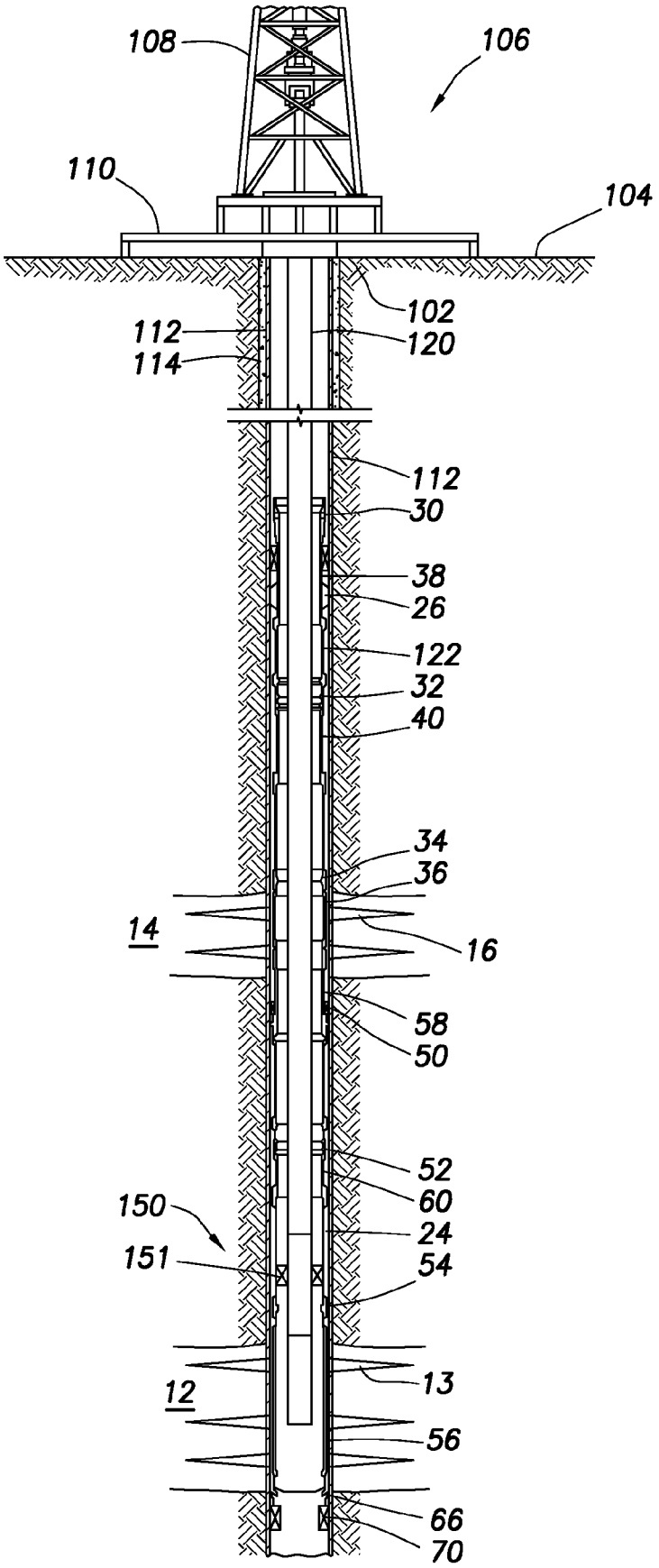
FIG. 1 is a schematic illustration of an embodiment of a wellbore operating environment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed infra may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," or "upward" meaning toward the surface of the wellbore and with "down," "lower," or "downward" meaning toward the terminal end of the well, regardless of the wellbore orientation. Reference to in or out will be made for purposes of description with "in," "inner," or "inward" meaning toward the center or central axis of the wellbore, and with "out,"

"outer," or "outward" meaning toward the wellbore tubular and/or wall of the wellbore. Reference to "longitudinal," "longitudinally," or "axially" means a direction substantially aligned with the main axis of the wellbore and/or wellbore tubular. Reference to "radial" or "radially" means a direction substantially aligned with a line between the main axis of the wellbore and/or wellbore tubular and the wellbore wall that is substantially normal to the main axis of the wellbore and/or wellbore tubular, though the radial direction does not have to pass through the central axis of the wellbore and/or wellbore tubular. The various characteristics mentioned above, as well as other features and characteristics described in more detail below, will be readily apparent to those skilled in the art with the aid of this disclosure upon reading the following detailed description of the embodiments, and by referring to the accompanying drawings.

During a workover procedure such as a gravel packing operation and/or a fracturing operation, various components may be used to locate a wellbore tubular string within an outer wellbore tubular string (e.g., an outer completion string, casing lining the wellbore, etc.). The alignment may be important to deliver the appropriate workover fluids or forces at the desired location. In addition, the weight of the wellbore tubular string may be at least partially supported by the outer wellbore tubular string to avoid relative movement between the strings in response to the various forces present during workover procedures. In order to locate the wellbore tubular string and transfer at least a portion of the weight of the wellbore tubular string within the outer wellbore tubular string, a weight down tool may be used with the wellbore tubular string to engage an indicator on the outer wellbore tubular string. For example, the weight down tool may engage a shoulder of an inner restriction, or the weight down tool may engage a recess disposed in the inner diameter of the outer wellbore tubular string. In order to perform one or more operations or procedures over multiple zones of a multi-zone completion, the weight down tool may need to be resettable to allow it to engage the outer wellbore tubular at a first location and then be conveyed to a second location and re-engaged with the outer wellbore tubular.

An indicator comprising an interior restriction may hinder the movement of tools and fluid through the interior of the outer wellbore tubular string during a workover operation and/or during production. As disclosed herein, a weight down tool may comprise retractable weight down lugs, which may expand upon being actuated to engage an indicator that is at least as large as various other restrictions present in the outer wellbore tubular. For example, typical completion assemblies comprise honed bores, and an indicator may have an inner diameter that is at least as large as a honed bore inner diameter. Moreover, a weight down tool may not comprise a collet. Collets generally comprise resilient members that must be biased inward to pass a restriction, as described in more detail herein. The use of the collets may wear the various restrictions in the wellbore such as the honed bores, potentially damaging the restrictions that are not meant to engage the weight down tool.

In some wellbores, it may be useful to have a weight down tool that actuates at a specific location or indicator, while not actuating at other locations or indicators. As disclosed herein, a weight down tool may comprise a keyed indicator profile, which may allow the weight down tool to only engage a desired indicator to actuate the weight down lugs. The keyed profile may allow for an increased actuation force when engaged with the corresponding indicator as compared to a non-corresponding indicator, thereby allowing for a relatively low locating force to be used. The low locating force may reduce wear on components as the keyed profile is conveyed through the wellbore.

The weight down tools disclosed herein may be used by conveying the weight down tool to a desired location. An indicator on the weight down tool may then be raised into a restriction, which may actuate the weight down lugs and configure the weight down tool in the weight down configuration. In this configuration, the weight down lugs may resist an axially and upwardly directed force to allow the weight down tool to support a load on an indicator in the wellbore. A subsequent application of an axially and downwardly directed force to the weight down lugs, for example by raising the weight down tool to engage the weight down lugs with a downwardly facing shoulder of a restriction, may cause the weight down lugs to retract and reset the weight down tool. Thus, the weight down tools disclosed herein allow for conveyance of the tool within the wellbore with reduced wear on the components in the wellbore and actuation at a desired location, both while being resettable to allow for the treatment of multiple zones in a multi-zone completion.

Referring to FIG. 1, an example of a wellbore operating environment in which a multi-position weight down tool may be used is shown. As depicted, the operating environment comprises a workover and/or drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 is illustrated as extending substantially vertically away from the earth's surface 104 over a vertical wellbore portion. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbores for drilling and completing one or more production zones. Further, the wellbore may be used for both producing wells and injection wells. The wellbore may also be used for purposes other than hydrocarbon production such as water recovery (e.g., potable water recovery), geothermal recovery and the like.

A wellbore tubular 120 may be lowered into the subterranean formation 102 for a variety of drilling, completion, workover, treatment, and/or production processes throughout the life of the wellbore 114. The embodiment shown in FIG. 1 illustrates the wellbore tubular 120 in the form of a completion and/or workover tubular string comprising a weight down tool 150 that is configured to be inserted within an outer wellbore tubular assembly 122 (e.g., a well screen assembly) disposed in the wellbore 114. In an embodiment, wellbore tubular 120 may comprise one or more additional components such as a centralizer configured to position wellbore tubular 120 centrally within outer wellbore tubular assembly 122. It should be understood that the wellbore tubular 120 is equally applicable to any type of wellbore tubulars being inserted into a wellbore including as non-limiting examples jointed pipe, drill pipe, casing, liners, coiled tubing, and any combination thereof. Further, the wellbore tubular 120 may operate in any of the wellbore orientations (e.g., vertical, deviated, horizontal, and/or curved) and/or types described herein. In an embodiment, the wellbore may comprise wellbore casing 112, which may be cemented into place in at least a portion of the wellbore 114.

The workover and/or drilling rig 106 may comprise a derrick 108 with a rig floor 110 through which the wellbore tubular 120 extends downward from the drilling rig 106 into the wellbore 114. The workover and/or drilling rig 106 may comprise a motor driven winch and other associated equipment for conveying the wellbore tubular 120 into the wellbore 114 to position the wellbore tubular 120 at a selected depth. While the operating environment depicted in FIG. 1 refers to a stationary workover and/or drilling rig 106 for conveying the wellbore tubular 120 within a land-based wellbore 114, in alternative embodiments, mobile workover rigs, wellbore servicing units (such as coiled tubing units), and the like may be used to convey the wellbore tubular 120 within the wellbore 114. It should be understood that a wellbore tubular 120 may alternatively be used in other operational environments, such as within an offshore wellbore operational environment.

The wellbore environment illustrated in FIG. 1 may be used in a gravel packing and/or fracturing operation, and the weight down tool 150 may be used to locate and set down weight on an outer wellbore tubular string 122 and/or the casing 112 during the gravel packing operation. In a typical gravel packing operation, a liner assembly (e.g., outer wellbore tubular assembly 122) having a perforated liner or screen may be disposed within a perforated casing and positioned adjacent the formation 102. A packer may be set above the zone between the liner and the well casing. The wellbore tubular 120 may be run inside the liner assembly at the area of the zone. A gravel slurry may be pumped down the wellbore tubular 120, through a crossover tool, and out into the annulus between the screen and the casing 112, and/or the outer wellbore tubular string 122 and the casing 112 below the packer at a suitable location above the zone where it descends. The gravel may be deposited in the area of the screen as the carrier fluid passes through the screen. The crossover tool routes the upward movement of the returning fluid back outside the outer wellbore tubular assembly 122, and the fluid then traveling up to the surface. Once a pressure build up is noted at the surface, the flow of gravel-laden fluid is stopped. After the gravel packing is completed, the wellbore tubular string 120 including the weight down tool 150 is generally moved and the circulation of fluid is reversed, a clean fluid being pumped down the annulus and back up the tubing in order to flush out sand remaining in the tubing. Subsequently, the well may be subject to other treatments, if necessary, and produced.

An outer wellbore tubular assembly 122 useful in performing such a gravel packing and/or fracturing operation is schematically illustrated in FIG. 1. As shown, the outer wellbore tubular assembly 122 (e.g., a completion assembly) may be used for a multi-zone completion. The outer wellbore tubular assembly 122 can comprise a production packer 30 at its upper end having slips 26 for supporting the outer wellbore tubular assembly 122 within an outer casing 112. The casing 112 may be disposed within a well having a plurality of production zones, such as lower zone 12 and upper zone 14 having perforations 13, 16, respectively, for the passage of hydrocarbons from zones 12, 14 into the annulus 24 formed between the outer wellbore tubular assembly 122 and the casing 112. The outer wellbore tubular assembly 122 may include any number of tools, and an isolation packer may be disposed between each set. For example, suitable tools may comprise an upper seal bore, a closing sleeve, a lower seal bore, an indicator collar, one or more screens, and/or one or more production sleeves.

The various tools may be provided in sets specific to each of the plurality of zones. For example, there may be an upper set of tools for the upper zone 14 and a lower set of tools for the lower zone 12 in a multi-zone completion. In an embodiment, the upper zone set of tools may be disposed below production packer 30 and may include an upper zone upper closing sleeve 32, an upper zone indicator collar 34, and an upper zone screen 36. An upper zone upper seal bore 38 may be disposed between production packer 30 and upper zone upper closing sleeve 32 and an upper zone lower seal bore 40 may be disposed between upper zone upper closing sleeve 32 and upper zone screen 36. An isolation packer 50 may be disposed between the adjacent upper and lower zone sets of tools. The lower zone set of tools may include a lower zone lower closing sleeve 52, a lower zone indicator collar 54, and lower zone screens 56 being disposed below isolation packer 50. A lower zone upper seal bore 58 may be disposed adjacent isolation packer 50 and a lower zone lower seal bore 60 may be disposed between lower zone lower closing sleeve 52 and lower zone indicator collar 54. The lower terminal end of the outer wellbore tubular assembly 122 may include a seal assembly 66 which may be received by a sump packer 70.

The weight down tool 150 may be used to locate the wellbore tubular 120 within the outer wellbore tubular assembly 122. As described in more detail herein, the weight down tool 150 may comprise one or more weight down lugs 151 for transferring a load from the wellbore tubular string 120 to the outer wellbore tubular assembly 122. The various restrictions within the outer wellbore tubular assembly 122 may provide locations for the weight down lugs 151 to engage the outer wellbore tubular assembly 122. Suitable restrictions may comprise any portion of the outer wellbore tubular assembly 122 and/or the casing 112 comprising a reduced diameter portion. In the context of FIG. 1, the restrictions may be present on the indicator collars 34, 54, seal bores 38, 40, 58, 60, sump packer 70, and the like.

It should be appreciated that although the wellbore tubular 120 and the outer wellbore tubular assembly 122 shown in FIG. 1 include only upper and lower zone sets of tools with an isolation packer disposed therebetween, additional sets of tools may be included with the completion string for gravel packing, fracturing, and/or otherwise treating additional production zones and that the present invention is not limited to treating only two production zones. As additional sets of tools are added to the outer wellbore tubular assembly 122, an additional isolation packer may be disposed between each additional adjacent set. The present invention may be used to complete any number of production zones in a multi-zone completion with one trip into the well.

In an embodiment, a weight down tool for use with a wellbore comprising a plurality of restrictions may generally comprise a central mandrel configured to be coupled to a wellbore tubular (e.g., a wellbore tubular string), an outwardly extending indicator, and a plurality of radially expandable weight down lugs configured to selectively transition between an expanded position and a retracted position. The indicator may be disposed about the central mandrel and configured to retract inwards in response to moving through one or more of the plurality of restrictions in a downwards direction. The indicator may be configured to expand the weight down lugs into the expanded position in response to moving through one or more restrictions of the plurality of restrictions in an upwards direction, and the weight down lugs may be configured to retract to the retracted position in response to the weight down lugs moving through one or more restrictions of the plurality of restrictions in an upwards direction. The weight down lugs may be configured to engage a restriction and prevent downwards movement of the central mandrel with respect to the restriction when the weight down lugs are disposed in the expanded position, thus supporting the weight down tool and any wellbore tubular string coupled to the weight down tool. The weight down lugs may be configured to remain out of engagement with the plurality of restrictions when the weight down lugs are in the retracted position. In some embodiments, the indicator may comprise a keyed profile, and at least one restriction of the plurality of restrictions comprises a profile configured to correspond to and engage the keyed profile. The keyed profile may then provide for selective actuation and engagement of the weight down tool with a desired restriction. In some embodiments, the weight down tool does not comprise a collet, which could damage the interior surface and/or one or more additional components (e.g., seals, etc.) of the outer wellbore tubular.

As described in more detail herein, a weight down tool may generally be used to apply weight to a restriction in a wellbore. For example, the indicator of the weight down tool may be raised into a restriction formed on an inner surface of an outer wellbore tubular. A plurality of weight down lugs may be expanded from a retracted position to an expanded position in response to raising the indicator into the restriction. Weight from the weight down tool may be transferred to the outer wellbore tubular using the plurality of weight down lugs that are configured to resist an axially and upwards directed force in the expanded position. For example, the weight down lugs may engage a restriction and transfer weight from the weight down tool to the restriction. The weight down tool may be reset for repositioning with the wellbore by applying an axially and downwardly directed force to the plurality of weight down lugs when the weight down lugs are in the expanded position. In response to applying the axially and downwardly directed force, the weight down lugs may retract from the expanded position to the retracted position to allow the weight down tool to be conveyed within the wellbore.

Figure 2:
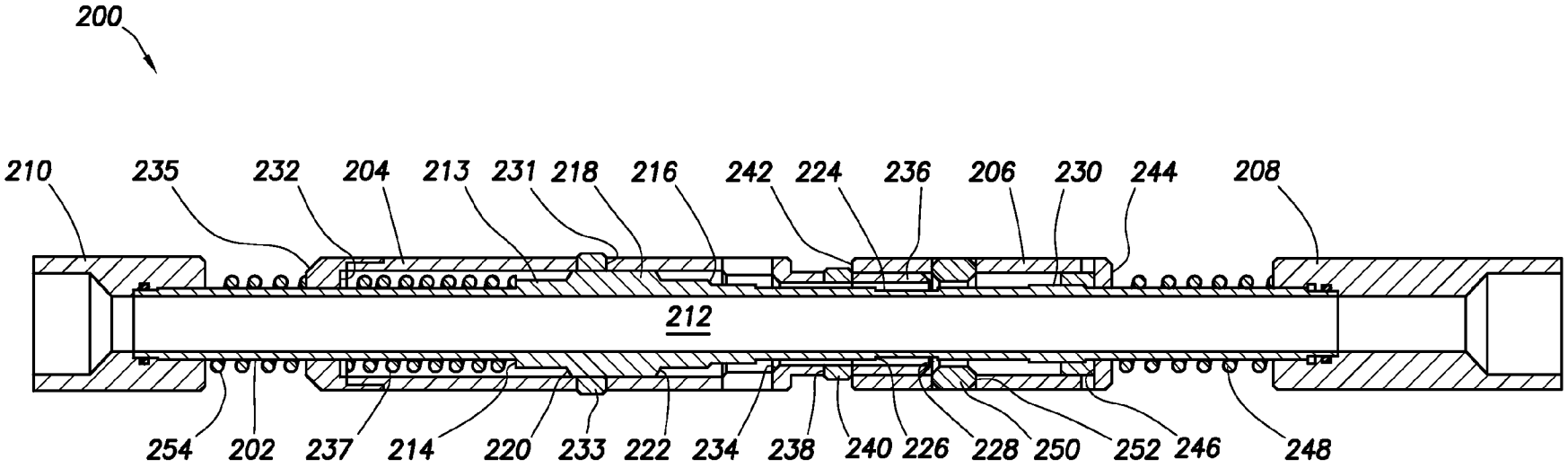
FIG. 2 is a cross-sectional view of an embodiment of a weight down tool.

An embodiment of a weight down tool 200 is illustrated in FIG. 2. The weight down tool 200 may be used in the environment illustrated with respect to the weight down tool 150 in FIG. 1. In general, the weight down tool 200 comprises a central mandrel 202 configured to be coupled to a wellbore tubular, a plurality of outwardly extending hunter lugs 233 disposed about the central mandrel 202, and a plurality of radially expandable weight down lugs 250 disposed about the central mandrel 202. The hunter lugs 233 are configured to retract in response to moving through an upper restriction in a downwards direction, and expand the weight down lugs 250 into an expanded position in response to moving through the upper restriction in an upwards direction. When the weight down lugs 250 are disposed in the expanded position, the weight down lugs 250 are configured to retract out of the expanded position in response to moving through the upper restriction in an upwards direction.

As shown in FIG. 2, the weight down tool 200 comprises a setting sleeve 204 and a weight down sleeve 206. The central mandrel 202 generally comprises a tubular body extending between a first end 208 and a second end 210. A flowbore 212 extends through the central mandrel 202 between the first end 208 and the second end 210, and the size of the flowbore 212 may be selected to allow fluid flow therethrough at a desired rate during normal operation of the wellbore tubular string 120. The first end 208 and/or the second end 210 may have suitable coupling devices or means to allow the weight down tool 200 to be coupled to one or more components. For example, the first end 208 and/or the second end 210 may comprise a threaded connection for coupling to an adjacent and correspondingly threaded component such as another tool or the wellbore tubular 120.

The central mandrel 202 comprises a multi-radius outer diameter, thereby creating a plurality of shoulders along its outer surface. A first enlarged diameter annular boss 213 may form a downwardly facing shoulder 216 and an upwardly facing shoulder 214. A second enlarged diameter annular boss 218 may form a downwardly facing shoulder 222 and an upwardly facing shoulder 220. A reduced diameter annular recess 224 may form an upwardly facing shoulder 228 and a downwardly facing shoulder 226.

The setting sleeve 204 comprises a cylindrical housing that is reciprocally and slidably mounted about the central mandrel 202. A first end 235 of the setting sleeve 204 comprises an inwardly directed flange to form a downwardly facing shoulder 232. A biasing member such as spring 237 can be disposed about the central mandrel 202 and engage the downwardly facing shoulder 232 of the setting sleeve 204 and the upwardly facing shoulder 214 of the central mandrel 202. The spring 237 can be configured to bias the shoulder 232 of the setting sleeve 204 away from the upwardly facing shoulder 214 of the central mandrel 202. A second end 236 of the setting sleeve 204 comprises a radially reduced diameter, thereby forming an upwardly facing shoulder 234. The upwardly facing shoulder 234 may be configured to engage the downwardly facing shoulder 216 on the central mandrel 202 during use, as described in more detail herein.

A biasing member such as spring 254 can be disposed about the central mandrel 202 above the setting sleeve 204. The spring 254 may engage the first end 235 of the setting sleeve 204 and a flange and/or component disposed adjacent the second end 210 of the weight down tool 200. The spring 254 may serve to bias the setting sleeve 204 away from the second end 210 of the weight down tool 200.

The setting sleeve 204 comprises one or more circumferentially spaced hunter lug windows 231. A plurality of hunter lugs 233 are respectively mounted in the hunter lug windows 231 for radial movements between a refracted position, wherein the hunter lugs 233 retract into the annular region between the setting sleeve 204 and the central mandrel 202, and an expanded position, wherein the hunter lugs 233 expand outward while a portion of the hunter lugs 233 remain retained by the setting sleeve 204. In an embodiment, one or more biasing members (e.g., leaf springs, coil springs, etc.) may bias the hunter lugs 233 into the retracted position.

The setting sleeve 204 also comprises one or more circumferentially spaced lockout lug windows 238. A plurality of lockout lugs 240 are respectively mounted in the lockout lug windows 238 for radial movements between a refracted position, wherein the lockout lugs 240 retract into the annular region between the setting sleeve 204 and the central mandrel 202, and an expanded position, wherein the lockout lugs 240 expand outward while a portion of the lockout lugs 240 remain retained by the setting sleeve 204. In an embodiment, one or more biasing members (e.g., leaf springs, coil springs, etc.) may bias the lockout lugs 240 into the refracted position.

The weight down sleeve 206 comprises a cylindrical housing that is reciprocally and slidably mounted about the central mandrel 202. A first end 242 of the weight down sleeve 206 is configured to extend over and receive the second end 236 of the setting sleeve 204. The distance with which the second end 236 of the setting sleeve 204 can be received within the weight down sleeve 206 can be limited by the position of the lockout lugs 240. A second end 244 of the weight down sleeve 206 comprises an inwardly directed flange, thereby forming an upwardly facing shoulder 246. The upwardly facing shoulder 246 may be configured to engage an annular flange 230 disposed about the central mandrel 202 to limit the travel of the weight down sleeve 206 with respect to the central mandrel 202 and support the weight down tool 200 in the weight down configuration. A biasing member such as spring 248 can be disposed about the central mandrel 202 below the weight down sleeve 206. The spring 248 may engage the second end 244 of the weight down sleeve 206 and a flange and/or component disposed adjacent the first end 208 of the weight down tool 200. The spring 248 may serve to bias the weight down sleeve 206 away from the first end 208 of the weight down tool 200.

The weight down sleeve 206 also comprises one or more circumferentially spaced weight down lug windows 252. A plurality of weight down lugs 250 are respectively mounted in the weight down lug windows 252 for radial movements between a retracted position, wherein the weight down lugs 250 retract into the annular region between the weight down sleeve 206 and the central mandrel 202, and an expanded position. In the expanded position, the weight down lugs 250 can be propped outward by the second end 236 of the setting sleeve 204 to expand outward while a portion of the weight down lugs 250 remains retained by the weight down sleeve 206. In an embodiment, one or more biasing members (e.g., leaf springs, coil springs, etc.) may bias the weight down lugs 250 into the refracted position.

In an embodiment, the outer diameter of the weight down lugs 250 may not extend beyond the outer surface of the weight down sleeve 206 when the weight down lugs 250 are in the refracted position. Upon expanding to the expanded position, the weight down lugs 250 may be configured to engage a desired restriction and/or indicator in the wellbore. As described in more detail herein, the desired restriction may have a larger inner diameter than the restriction used to actuate the weight down lugs into the expanded position. This may allow the weight down tool 200 to pass through the desired restriction without contact, thereby reducing wear on the weight down tool 200, any equipment associated with the weight down tool 200, and/or the desired restriction itself.

In use, the weight down tool 200 is configured so that it may pass upwardly and/or downwardly through one or more restrictions without transferring weight to any of the restrictions until being armed. In order to arm the weight down tool 200, the weight down tool 200 may be disposed between two indicators (e.g., above the desired indicator and below an upper indicator), and then raised until the hunter lugs 233 contact the upper indicator so that the setting sleeve 204 moves under and props the weight down lugs 250. The weight down tool 200 can then be lowered to allow the weight down lugs 250 to engage the desired indicator and support the tool and any associated tools, equipment, and/or wellbore tubulars. The weight down tool 200 can then be reset by raising the weight down lugs 250 into the upper indicator to allow the weight down tool 200 to once again be conveyed upwardly and/or downwardly through one or more restrictions.

The run-in configuration (e.g., un-armed configuration) may be as shown in FIG. 2. In this configuration, the hunter lugs 233 are in the expanded position due to the hunter lugs 233 being radially aligned with and propped outward by the annular boss 218. The lockout lugs 240 are supported and propped outward by the central mandrel 202. The lockout lugs 240 engage the first end 242 of the weight down sleeve 206, thereby preventing the weight down sleeve 206 from being biased upward by spring 248 and moving over the reduced diameter portion of the setting sleeve 204. As a result of the engagement between the lockout lugs 240 and the first end 242 of the weight down sleeve 206, the weight down lugs 250 are free to retract into the retracted position, and in an embodiment, may be maintained in the retracted position by a biasing element.

Figure 3:
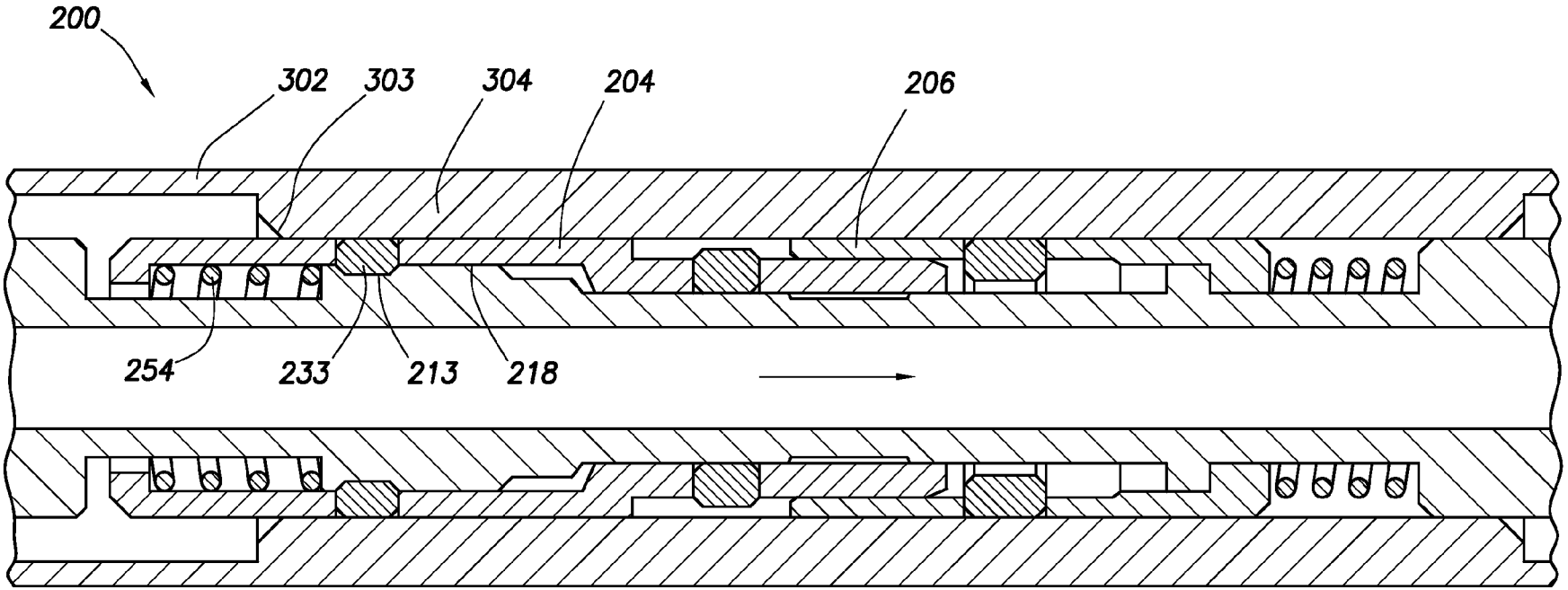
FIG. 3 is another cross-sectional view of an embodiment of a weight down tool.

The weight down tool 200 may pass downwardly through a restriction in the run-in configuration. As shown in FIG. 3, an outer wellbore tubular 302 may comprise a reduced diameter portion 304 (e.g., an internal restriction), thereby forming an upwards facing shoulder 303. The reduced diameter portion 304 may comprise any number of indicators such as an honed bore, an internal indicator, or the like. Further, the shoulder 303 may have a beveled, rounded, or angled edge to assist in guiding the weight down tool 200 through the restriction. As the weight down tool 200 passes through the reduced diameter portion 304, the weight down sleeve 206 may pass through the reduced diameter portion 304 as a result of having a smaller outer diameter than the inner diameter of the reduced diameter portion 304. The weight down lugs 250 may be in the retracted position and therefore not engage the shoulder 303 or the reduced diameter portion. The hunter lugs 233 may be in the expanded position and engage the shoulder 303. As the weight down tool 200 moves downward (e.g., to the right in FIG. 3), the setting sleeve 204 may be displaced upwards relative to the central mandrel 202 as a result of the interaction between the hunter lugs 233 and the shoulder 303, thereby compressing spring 254. When the setting sleeve 204 displaces until the hunter lugs 233 align with the annular boss 213, the hunter lugs 233 may no longer be propped outwards by the second enlarged diameter annular boss 218 and can move radially inward into the retracted position. In this position, the hunter lugs 233 may not engage the shoulder 303 or the reduced diameter portion 304. When the weight down tool 200 moves past the reduced diameter portion 304, the setting sleeve 204 may move downwards due to the biasing force of the spring 254. The hunter lugs 233 may then be realigned with the second enlarged diameter annular boss 218 and propped outwards in the expanded position. Thus, the setting sleeve 204 may move upwards from the run-in position as the weight down tool 200 moves downwardly past a restriction and return to the run-in configuration once the weight down tool 200 passes the restriction. The weight down tool 200 may then be conveyed downwardly through the wellbore to just above a desired location where weight is to be supported by the weight down tool 200.

Figure 4A:
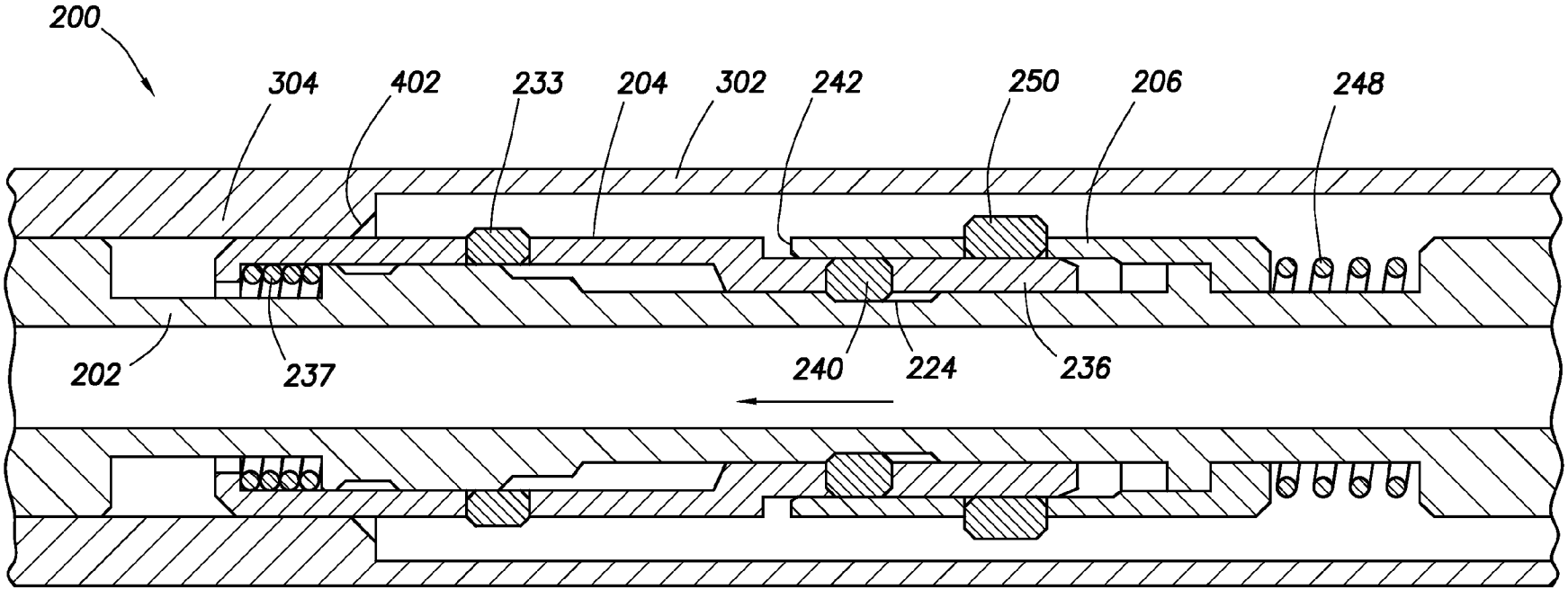
FIGS. 4A and 4B are still additional cross-sectional views of an embodiment of a weight down tool.
Figure 4B:
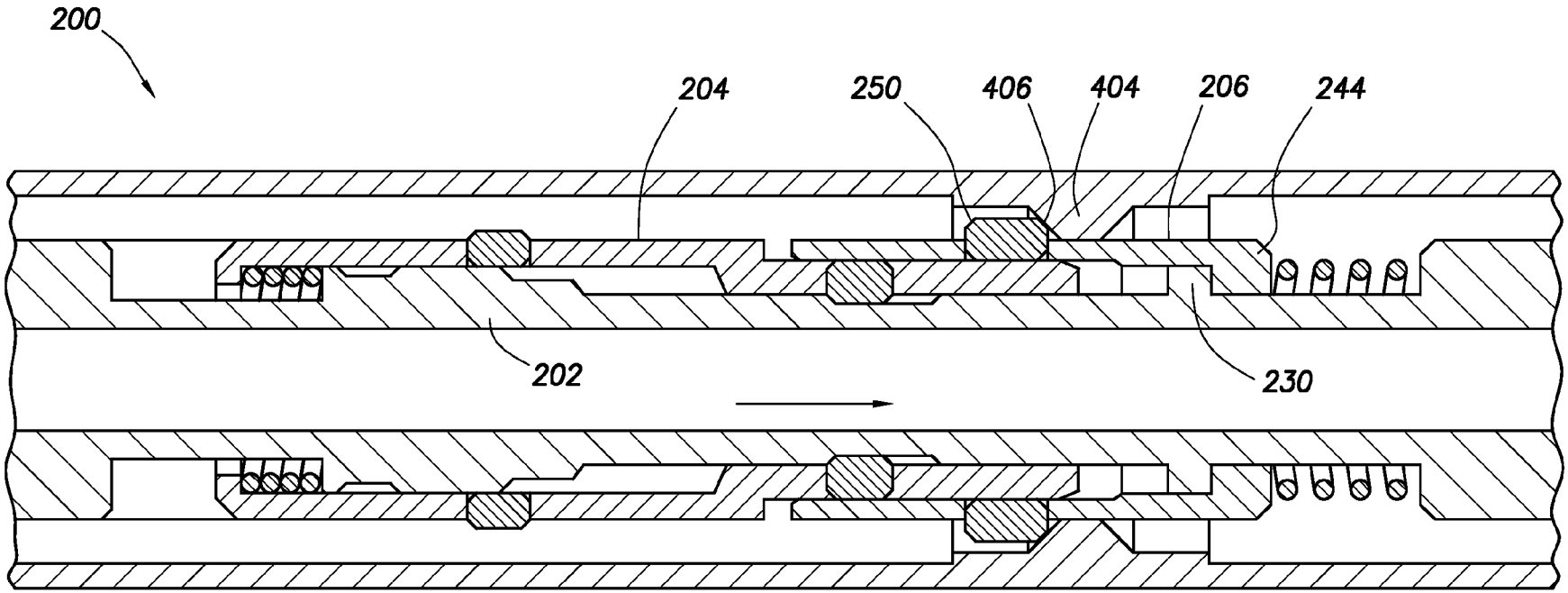

Referring to FIGS. 4A and 4B, the weight down tool 200 may be placed in a weight down configuration (e.g., an armed configuration) by raising the weight down tool 200 to engage a restriction with the hunter lugs 233 of the setting sleeve 204 without allowing the weight down lugs 250 to engage the restriction. As shown in FIG. 4A, the outer wellbore tubular 302 may comprise the reduced diameter portion 304, thereby forming a downwards facing shoulder 402. The shoulder 402 may have a beveled, rounded, or angled edge to assist in guiding the weight down tool 200 through the restriction. As the weight down tool 200 passes through the reduced diameter portion 304 in an upward direction, the hunter lugs 233 may be in the expanded position and engage the shoulder 402. As the weight down tool 200 moves upwards (e.g., to the left in FIG. 4A), the setting sleeve 204 may be displaced downwards relative to the central mandrel 202 as a result of the interaction between the hunter lugs 233 and the shoulder 402, thereby compressing spring 237. As the setting sleeve 204 moves downwards relative to the central mandrel 202, the lockout lugs 240, which are in the expanded position due to being propped outwards by the central mandrel 202, engage the upwards facing shoulder formed on the first end 242 of the weight down sleeve 206. The weight down sleeve 206 may then move downwards relative to the central mandrel 202 and compress the spring 248. When the setting sleeve 204 displaces a sufficient distance downwards relative to the central mandrel 202, the lockout lugs 240 radially align with the reduced diameter annular recess 224, allowing the lockout lugs 240 to radially retract into the retracted position. When the lockout lugs 240 are in the retracted position, the weight down sleeve 206 may no longer be restricted by the lockout lugs 240 and move upwards in response to the biasing force of spring 248. The weight down sleeve 206 may move upwards over the second end 236 of the setting sleeve 204 to align the second end 236 of the setting sleeve 204 with the weight down lugs 250. The second end 236 of the setting sleeve 204 may have a beveled, rounded, or angled edge to assist in guiding the second end 236 of the setting sleeve 204 under the weight down lugs 250. When the weight down sleeve 206 moves upwards, the first end 242 of the weight down sleeve 206 may radially align with and be disposed about the lockout lugs 240, thereby preventing the lockout lugs 240 from expanding outwards into the expanded position. The interaction between the weight down sleeve 206 and the lockout lugs 240 may prevent the setting sleeve from moving upwards by trapping the lockout lugs 240 in the reduced diameter annular recess 224. Once the second end 236 of the setting sleeve 204 is radially aligned with the weight down lugs 250, the weight down lugs 250 may be propped outwards to allow the weight down tool 200 to support weight on the weight down lugs 250.

As shown in FIG. 4B, the weight down tool in the weight down configuration may then be lowered until the weight down tool 200 encounters a reduced diameter restriction 404 that has an inner diameter that is less than the outer diameter of the weight down lugs 250 in the expanded position. The reduced diameter restriction 404 may form an upwards facing shoulder 406 that engages the weight down lugs 250. Weight may then be applied to the tubular string and supported by the engagement between the weight down lugs 250 and the restriction 404 in the wellbore. In this embodiment, the load path of the wellbore tubular string is along the central mandrel 202, through the annular flange 230 of the central mandrel 202, through the inwardly directed flange on the second end 244 of the weight down sleeve 206, along the weight down sleeve 206, through the weight down lugs 250, and onto the shoulder 406 of the reduced diameter restriction 404. Weight may be applied as needed to perform one or more workover, completion, and/or production operations.

In an embodiment, the reduced diameter restriction 404, may have a larger inner diameter than the inner diameter of the reduced diameter portion 304, where the reduced diameter restriction 404 is located below the reduced diameter portion 304. In the expanded position, the weight down lugs 250 may extend outwards to engage the reduced diameter restriction 404. When the weight down lugs 250 are in the expanded position, the outer diameter of the weight down lugs 250 may be greater than the outer diameter of the setting sleeve 204 and/or the outer diameter of the hunter lugs 233 when the hunter lugs 233 are aligned with the second enlarged diameter annular boss 218. The weight down lugs 250 may then be used to apply weight to a reduced diameter restriction 404 in the expanded position while limiting the amount of contact between the various components of the weight down tool 200 and a desired restriction or indicator (e.g., the reduced diameter restriction 404). This configuration may potentially extend the life of the various components of the weight down tool 200 or tool string (e.g., the seals associated with the weight down tool). For example, the inner diameter of the reduced diameter restriction 404 may be larger than the inner diameter of the reduced diameter portion 304, and the outer diameter of seals associated with the weight down tool 200 may be larger than the inner diameter of the reduced diameter portion 304 but smaller than inner diameter of the reduced diameter restriction. Thus when the weight down lugs 250 are in the retracted position, the seals may engage the reduced diameter portion 304, but neither the weight down lugs 250 nor the seals may contact the reduced diameter restriction 404. This may be beneficial in limiting wear on the components of the system while still allowing the weight down lugs 250 to be expanded and place weight on a desired restriction or indicator.

Figure 5:
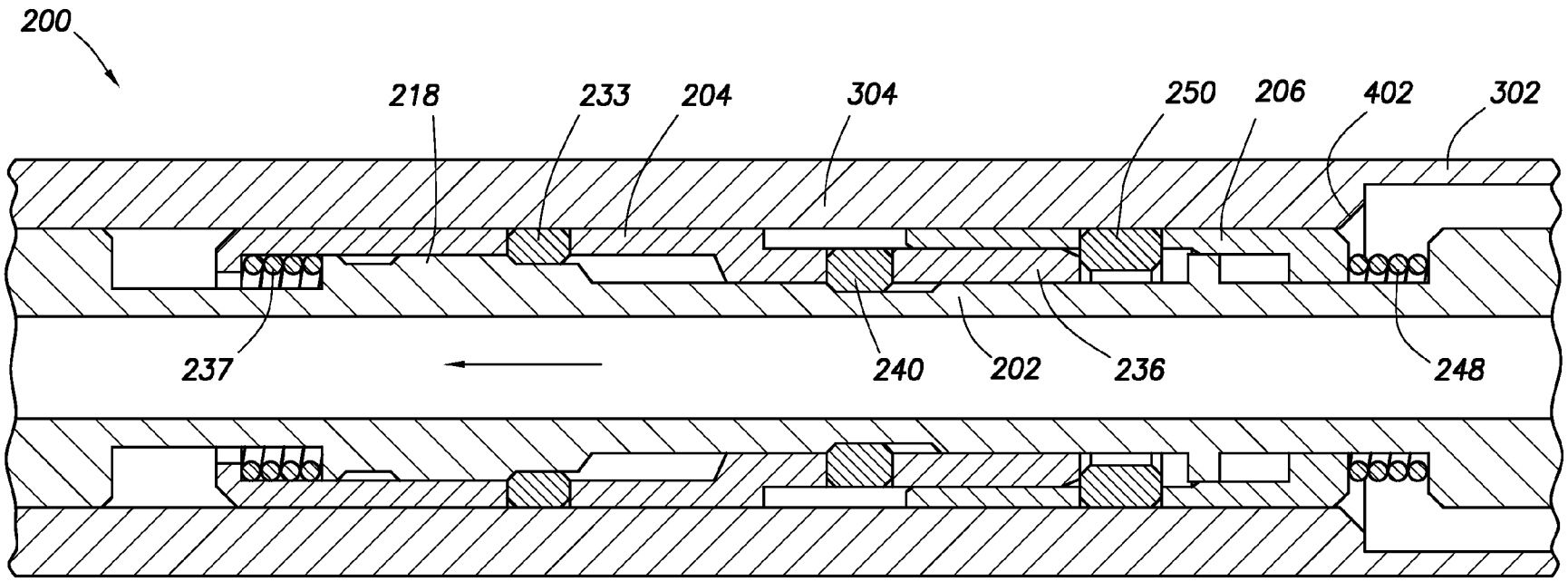
FIG. 5 is yet another cross-sectional view of an embodiment of a weight down tool.

Once it is desired to convey the weight down tool 200 to another location in the wellbore, the weight down tool 200 may be reset by raising the weight down tool through a restriction until the restriction engages the weight down lugs 250 and displaces them downwards a sufficient distance to reset the weight down tool 200 as well as allowing the hunter lugs 233 to clear the upper shoulder 406 of the restriction. As shown in FIG. 5, the outer wellbore tubular 302 may comprise the reduced diameter portion 304, thereby forming the downwards facing shoulder 402. As the weight down tool 200 configured in the weight down configuration passes through the reduced diameter portion 304 in an upward direction, the hunter lugs 233 may be in the retracted position and pass upwards through the reduced diameter portion 304. Further upward movement may engage the weight down lugs 250 with the downwards facing shoulder 402 to apply a downwardly directed longitudinal force to the weight down lugs 250, causing the weight down sleeve 206 to move downwards with respect to the central mandrel 202 and compress the spring 248. The weight down sleeve 206 may continue to move downwards until the weight down lugs are out of alignment with the second end 236 of the setting sleeve 204, thereby allowing the weight down lugs 250 to collapse inwards into the retracted position. In this configuration, the hunter lugs 233 are prevented from moving outwards into the expanded position by the reduced diameter portion 304 of the outer wellbore tubular 302 as well as being prevented from moving upwards due to the interaction of the hunter lugs 233 with the second enlarged diameter annular boss 218.

When the weight down tool 200 begins to move above the reduced diameter portion 304, the setting sleeve 204 is the first to clear the restriction 304. Once the hunter lugs 233 are no longer prevented from moving outwards into the expanded position, the setting sleeve 204 may move upwards due to the biasing force of the compressed spring 237, and the hunter lugs 233 may expand and radially align with the second enlarged diameter annular boss 218. The lockout lugs 240 may not be in radial alignment with the weight down sleeve 206 due to the downward movement of the weight down sleeve 206. The upwards movement of the setting sleeve may then move the lockout lugs 240 upwards, where the lockout lugs 240 may expand into the expanded position due being propped outwards by the central mandrel 202. The setting sleeve may then return to the position illustrated in FIG. 2. As the setting sleeve moves upwards, the weight down sleeve will also move upwards due to the biasing force of the spring 248. The weight down sleeve 206 will follow the upwards movement of the setting sleeve 204 as the weight down lugs 250 engage the second end 236 of the setting sleeve 204. Once the setting sleeve 204 clears the upper shoulder of the restriction 304 while the weight down lugs 250 are within the restriction 304, the weight down tool 200 will reset to the run-in configuration illustrated in FIG. 2. The weight down tool may then be retrieved from the wellbore, raised through one or more restrictions within the outer wellbore tubular 302, and/or lowered through one or more restrictions in the outer wellbore tubular 302 without returning to the weight down configuration. In order to return to the weight down configuration, the process described above can be repeated and weight placed on a suitable restriction.

In an embodiment, the weight down tool 200 may be used to apply weight to a restriction in a wellbore. For example, the setting sleeve disposed about a central mandrel may be raised through an upper restriction in a wellbore. In response to raising the setting sleeve though the upper restriction, the plurality of weight down lugs 250 may be expanded from a retracted position to an expanded position. The plurality of weight down lugs may then be engaged with a lower restriction in the wellbore, and weight may be applied to the lower restriction using the plurality of weight down lugs 250. In order to reset the weight down tool 200 to allow the weight down tool 200 to be relocated and/or retrieved from the wellbore 114, the setting sleeve 204 may be raised through the upper restriction, and the plurality of weight down lugs 250 may be raised into the upper restriction. The weight down lugs 250 may then retract out of the expanded position in response to the setting sleeve 204 being raised through the upper restriction and the plurality of weight down lugs 250 being raised into the upper restriction.

In an embodiment, a weight down tool may be used to set down weight in a specific location using a profiled indicator within the wellbore. This may provide simpler operations within a multi-zone environment while reducing wear on various reduced diameter components within the wellbore. In an embodiment, the weight down tool may comprise a central mandrel configured to be coupled to a wellbore tubular, and an outwardly extending indicator disposed about the central mandrel that may comprise a keyed profile. The indicator may be configured to retract inwards in response to moving through an upper restriction in a downwards direction. A plurality of radially expandable weight down lugs may be configured to engage a lower restriction that comprises a profile configured to correspond to and engage the keyed profile. The weight down lugs may prevent downwards movement of the central mandrel with respect to the lower restriction when disposed in an expanded position. The indicator may be configured to expand the weight down lugs into the expanded position in response to moving through the lower restriction in an upwards direction, and the weight down lugs may be configured to retract out of the expanded position in response to moving through the upper restriction in an upwards direction.

Figure 6:
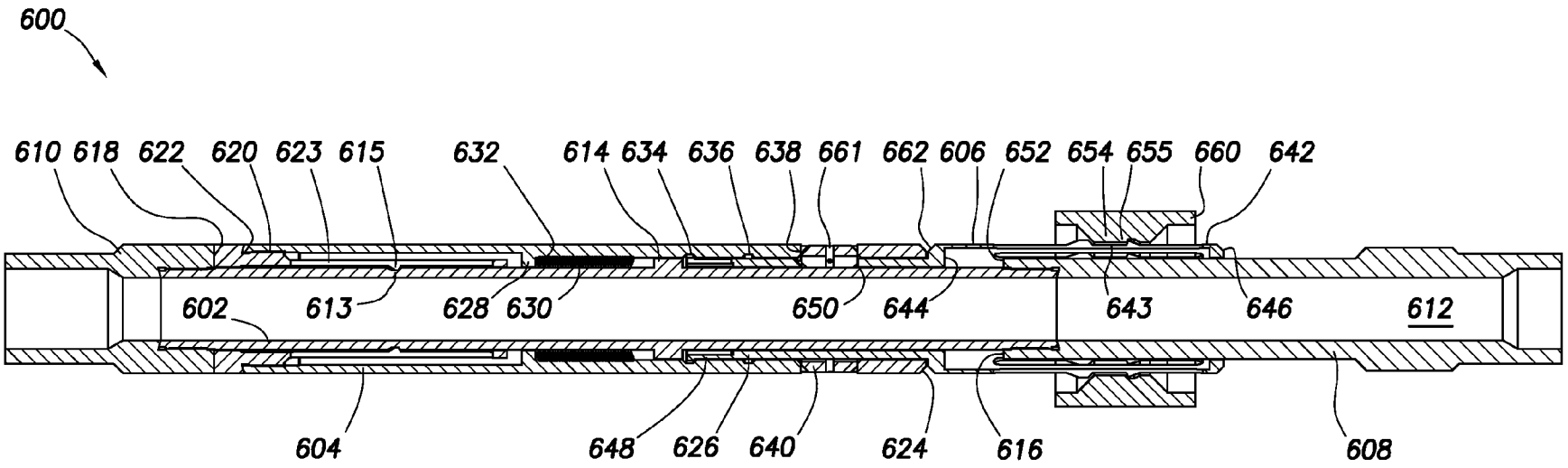
FIG. 6 is a cross-sectional view of another embodiment of a weight down tool.

An embodiment of such a weight down tool 600 is illustrated in FIG. 6. The weight down tool 600 may be used in the environment illustrated with respect to the weight down tool 150 in FIG. 1. The weight down tool 600 comprises a central mandrel 602, an upper housing 604, and an indicator sleeve 606. The central mandrel 602 generally comprises a tubular body extending between and coupled to a first end 608 and a second end 610. While illustrated as comprising a central mandrel 602, a first end 608, and a second end 610 that are coupled together (e.g., using a threaded connection or the like), the central mandrel 602 may also be integrally formed as a single, unitary piece extending between each end and having a multi-radius outer diameter. A flowbore 612 extends through the central mandrel 602 between the first end 608 and the second end 610, and the size of the flowbore 612 may be selected to allow fluid flow therethrough at a desired rate during normal operation of the wellbore tubular string 120. The first end 608 and/or the second end 610 may have suitable coupling devices or means to allow the weight down tool 600 to be coupled to one or more components. For example, the first end 608 and/or the second end 610 may comprise a threaded connection for coupling to an adjacent and correspondingly threaded component such as another tool or the wellbore tubular 120.

The central mandrel 602 comprises a multi-radius outer diameter, thereby creating a plurality of shoulders along its outer surface. A reduced diameter collet indicator 613 may be disposed along the outer diameter of the central mandrel 602. The collet indicator 613 may have a beveled, rounded, or angled profile configured to determine the entry and exit forces associated with a collet indicator latching into and out of the collet indicator 613, as described in more detail herein. The central mandrel 602 may also comprise an annular flange 614 disposed about the central mandrel 602. The first end 608 may have an outer diameter that is greater than the outer diameter of the central mandrel 602, thereby forming an upward facing shoulder 616. Similarly, the second end 610 may have an outer diameter that is greater than the outer diameter of the central mandrel 602, thereby forming a downward facing shoulder 618.

The upper housing 604 comprises a cylindrical housing that is reciprocally and slidably mounted about the central mandrel 602. A first end 620 of the upper housing 604 can be fixedly coupled to a collet body 622 using any suitable coupling mechanism, such as a threaded connection. The collet body 622 can be reciprocally and slidably disposed about the central mandrel, and the collet body 622 can engage the downwardly facing shoulder 618 of the second end 610 of the central mandrel 602. A second end 624 of the upper housing 604 extends longitudinally along the central mandrel 602 over a first end 626 of the indicator sleeve 606. An inwardly directed flange 628 can extend from the upper housing 604 and may form a downwardly facing shoulder 632. A biasing member 630 may be disposed between the downwardly facing shoulder 632 of the upper housing 604 and the annular flange 614 of the central mandrel 602, and the biasing member 630 may serve to bias the upper housing 604 upwards relative to the central mandrel 602 such that the collet body 622 engages the downwardly facing shoulder 618. The biasing member 630 may comprise any number of mechanisms configured to bias the upper housing 604 upwards relative to the central mandrel 602 including, but not limited to, a coil spring, a wave spring stack, a Bellville washer stack, an elastomeric element, any combination thereof, or any other suitable biasing mechanism. A plurality of collet indicators 634, 636 can be disposed on the inner surface of the upper housing 604. The collet indicators 634, 636 generally comprise circumferential recesses configured to engage a collet indicator.

The upper housing 604 comprises one or more circumferentially spaced weight down lug windows 638. A plurality of weight down lugs 640 are respectively mounted in the weight down lug windows 638 for radial movements between a refracted position, wherein the weight down lugs 640 retract into the annular region between the upper housing 604 and the central mandrel 602, and an expanded position, wherein the weight down lugs 640 expand outward while a portion of the weight down lugs 640 remain retained by the upper housing 604. In an embodiment, one or more biasing members 661 (e.g., leaf springs, coil springs, etc.) may bias the weight down lugs 640 into the refracted position.

The indicator sleeve 606 comprises a cylindrical housing that is reciprocally and slidably mounted about the central mandrel 602. The first end 626 of the indicator sleeve 606 is configured to extend under and be received by the second end 624 of the upper housing 604. The first end 626 comprises a collet having collet fingers 648 configured to engage the collet indicators 634, 636 on the inner surface of the upper housing 604. The first end 626 also comprises one or more circumferentially spaced lug windows 650 that can selectively aligned with and receive the weight down lugs 640 in the run-in configuration. The second end 642 of the indicator sleeve 606 comprises an inwardly directed flange 646 that engages the first end 608 of the central mandrel 602. The second end 642 of the indicator sleeve 606 has a larger inner diameter than the first end 626 of the indicator sleeve, thereby forming downwardly facing shoulder 644.

A second end 642 of the indicator sleeve 606 may comprise a collet having an outer indicator profile 643. The indicator profile 643 generally comprises one or protrusions and/or recesses that are keyed for engagement with a corresponding profile on a restriction within the wellbore. The interaction between the two profiles may be used to actuate the weight down tool 600 between the run-in configuration and the weight down configuration. The protrusions and/or recesses may generally comprise circumferential extensions or contractions on the outer surface of the collet fingers. When the indicator profile 643 engages a restriction within the wellbore, the collet fingers may compress inwards to allow the indicator profile to pass by the restriction. When the indicator profile 643 matches a corresponding profile 655 (e.g., a reverse profile) on the restriction, the collet fingers may expand outwards to engage the corresponding profile 655. The engagement of the two profiles 643, 655 may require an axial force above a threshold to be applied to the indicator sleeve 606 to disengage the indicator profile 643 from the corresponding profile 655. A force up to the threshold force can then be used to shift the indicator sleeve 606 at a suitable location within the wellbore. When the indicator profile 643 does not match the corresponding profile 655, the collet fingers may not expand or may not expand to an extent sufficient to allow the indicator sleeve 606 to be shifted and thereby arm the weight down tool 600. The keyed indicator profile 643 may comprise as many protrusions and/or recesses as necessary to differentiate the various restrictions within the wellbore. In some embodiments, the indicator profile may comprise a relatively simple protrusion or recess to allow the weight down tool 600 to be used with any restriction within the wellbore. Thus, the weight down tool 600 can be used with as a selective actuation mechanism with a keyed restriction or as a weight down tool 600 configured to actuate on one or more non-keyed restrictions within the wellbore.

The weight down tool 600 may comprise a plurality of collets including, but not limited to, the collet body 622 including collet fingers 623, collet fingers 648, and/or collet comprising the indicator profile 643. In general, a collet comprises one or more fingers that act as springs (e.g., beam springs) and/or spring means separated by slots (e.g., slot 652). In an embodiment, the slots may comprise longitudinal slots, angled slots, as measured with respect to the longitudinal axis, helical slots, and/or spiral slots for allowing at least some radial compression in response to a radially compressive force. A collet may generally be configured to allow for a limited amount of radial compression of the fingers in response to a radially compressive force, and/or a limited amount of radial expansion of the fingers in response to a radially expansive force. The collet also comprises a collet lug or indicator disposed on the outer surface of the fingers.

In an embodiment, the collet body 622 used with the weight down tool as shown in FIG. 6 may be configured to allow for a limited amount of radial expansion of the collet fingers 623 in response to a radially expansive force. The expansive force may be supplied by the interaction of the collet lug 615 with the indicator 613 disposed in the central mandrel 602, each of which may have sloped, angled, or beveled sides. The selection of the slope and/or angle of the sides in addition to the properties of the fingers may determine the amount of force required to snap the collet lug 615 out of the indicator 613. The collet fingers 648 disposed on the first end 626 of the indicator sleeve 606 may be configured to allow for a limited amount of radial compression of the collet fingers in response to a radially expansive force, which may result from an axial force applied to the indicator sleeve 606 during actuation of the weight down tool 600. Similarly, the collet comprising the indicator profile 643 may be configured to allow for a limited amount of radial compression in response to a radial compressive force, which may result from the interaction of the indicator profile 643 with one or more restrictions in the wellbore.

In use, the weight down tool 600 is configured so that it may pass upwardly and/or downwardly through one or more restrictions without placing weight on any of the restrictions until being armed. In order to arm the weight down tool 600, the weight down tool 600 may be engaged with and/or raised through a restriction comprising the corresponding profile for the indicator profile to translate the indicator sleeve 606 and expand the weight down lugs 640. The weight down tool 600 can then be lowered to allow the weight down lugs 640 to engage the restriction and support the tool and any associated tools, equipment, and/or wellbore tubulars. The weight down tool can then be reset by raising the weight down tool so that the weight down lugs 640 pass into a restriction.

The run-in configuration (e.g., un-armed configuration) may be as shown in FIG. 6. In this configuration, the weight down lugs 640 are in the retracted position such that the weight down lugs 640 have an outer diameter that is generally about the same as or less than the outer diameter of the upper housing 604. The indicator profile 643 on the second end 642 of the indicator sleeve 606 may have an outer diameter than is greater than the outer diameter of the upper housing 604 and/or the indicator sleeve 606, allowing the indicator profile 643 to interact with any restrictions in the wellbore.

The weight down tool 600 may pass through a restriction in the run-in configuration. As shown in FIG. 6, the indicator profile 643 may engage a restriction 654 as the weight down tool passes downwards through the restriction 654. Upon encountering the restriction 654, the indicator profile 643 may expand into the profile when the corresponding profile 655 on the restriction 654 matches the profile of the indicator profile 643, or may pass by the restriction 654 when the profiles do not match. In an embodiment, the ability to key into a specific restriction may allow the weight down tool to be selectively actuated at a desired restriction having a matching profile. If the weight down tool 600 continues to move downwards, the indicator profile may contract inward if engaged with the restriction to snap out of the profile 655 or simply pass by with a minimal restrictive force if the profiles do not match. Any force required to pass by and/or snap out of the profile 655 is supported by the engagement of the second end 610 of the central mandrel 602 with the downward facing shoulder 618, the downward facing shoulder 618 with the collet body 622, the collet body 622 with the upper housing 604, through the upper housing 604 to the second end 624 of the upper housing 604, and the second end 624 with the indicator sleeve 606. The weight down tool 600 may then pass through one or more additional restrictions without the weight down lugs 640 placing weight on the restrictions.

Figure 7:
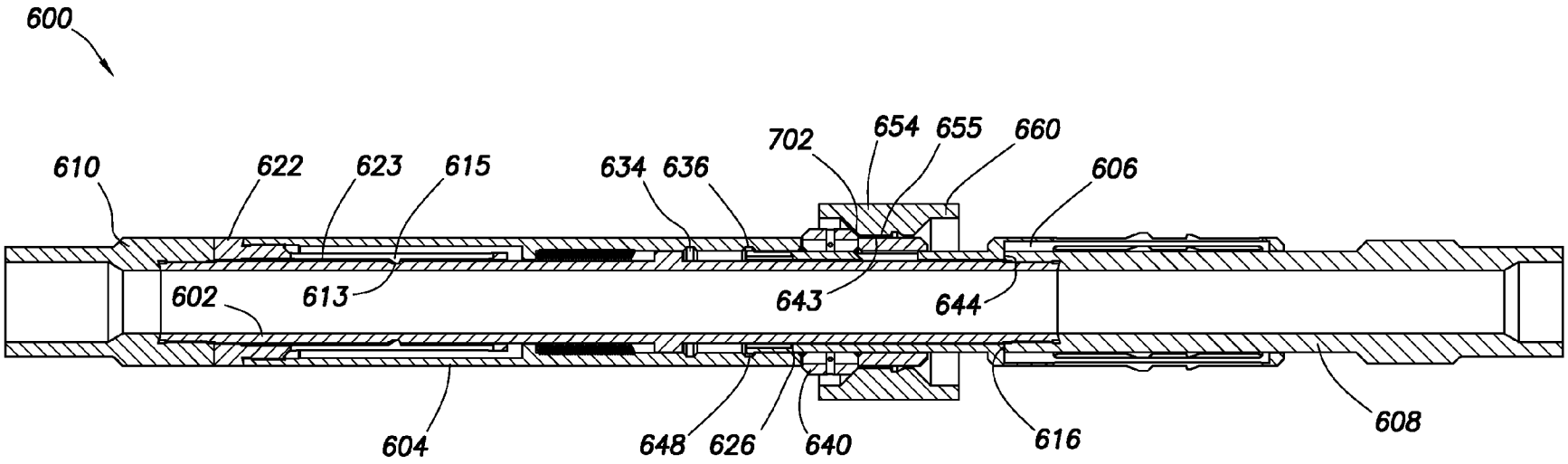
FIG. 7 is another cross-sectional view of an embodiment of a weight down tool.

Referring to FIGS. 6 and 7, the weight down tool 600 may be placed in a weight down configuration (e.g., an armed configuration) by engaging the indicator profile 643 with a corresponding profile 655 in the restriction 654 and raising the weight down tool 600 to actuate the weight down lugs 640. When the indicator profile 643 has engaged a corresponding profile 655 as shown in FIG. 6, the weight down tool 600 may be raised. The engagement between the indicator profile 643 and the restriction 654 may provide a sufficient force to shift the indicator sleeve 606 downwards relative to the central mandrel 602. As the indicator sleeve 606 moves downwards, the lug windows 650 in the first end 626 of the indicator sleeve 606 move out of alignment with the weight down lugs 640, thereby propping the weight down lugs 640 into the expanded position. As the indicator sleeve 606 moves downwards, the collet fingers 648 disengage from the indicator 634. The relative force required to disengage the collet fingers 648 from the indicator 634 may be less than the force required to disengage the collet lug 615 from the collet indicator 613 in the central mandrel 602. As a result, the upper housing 604 may be prevented from moving downwards from the force of the collet fingers 648 engaged with the indicator 634 due to the engagement of the collet lug 615 on the collet fingers 623 with the collet indicator 613 in the central mandrel 602. The indicator sleeve 606 may continue to move downwards until the downwardly facing shoulder 644 on the indicator sleeve 606 engages the upward facing shoulder 616 formed by the first end 608 of the central mandrel 602. In this position, the collet fingers 648 may engage the second indicator 636 and provide a sufficient retaining force to remain engaged with the second indicator 636 while disengaging the indicator profile 643 from the restriction 654. The resulting configuration of the weight down tool 600 may then be as shown in FIG. 7.

As shown in FIG. 7, the weight down tool 600 in the weight down configuration may then be lowered until the weight down tool 600 encounters a reduced diameter restriction 654 that has an inner diameter that is less than the outer diameter of the weight down lugs 640 in the expanded position. The reduced diameter restriction 654 may form an upwards facing shoulder 702 that engages the weight down lugs 640. Weight may then be applied to the tubular string and supported by the engagement between the weight down lugs 640 and the restriction 654 in the wellbore. In this embodiment, the load path of the wellbore tubular string is along the second end 610 of the central mandrel 602, through the collet body 622, through the upper housing 604, through the weight down lugs 640, and onto the shoulder 702 of the reduced diameter restriction 654. The tubular string below the weight down tool 600 may be supported by the central mandrel, for example, through the coupling between the second end 610 and the central mandrel 602, through the central mandrel 602, and through the first end 608 of the central mandrel to wellbore tubular below the weight down tool 600. Weight may be applied as needed to perform one or more workover, completion, and/or production operations.

Figure 8:
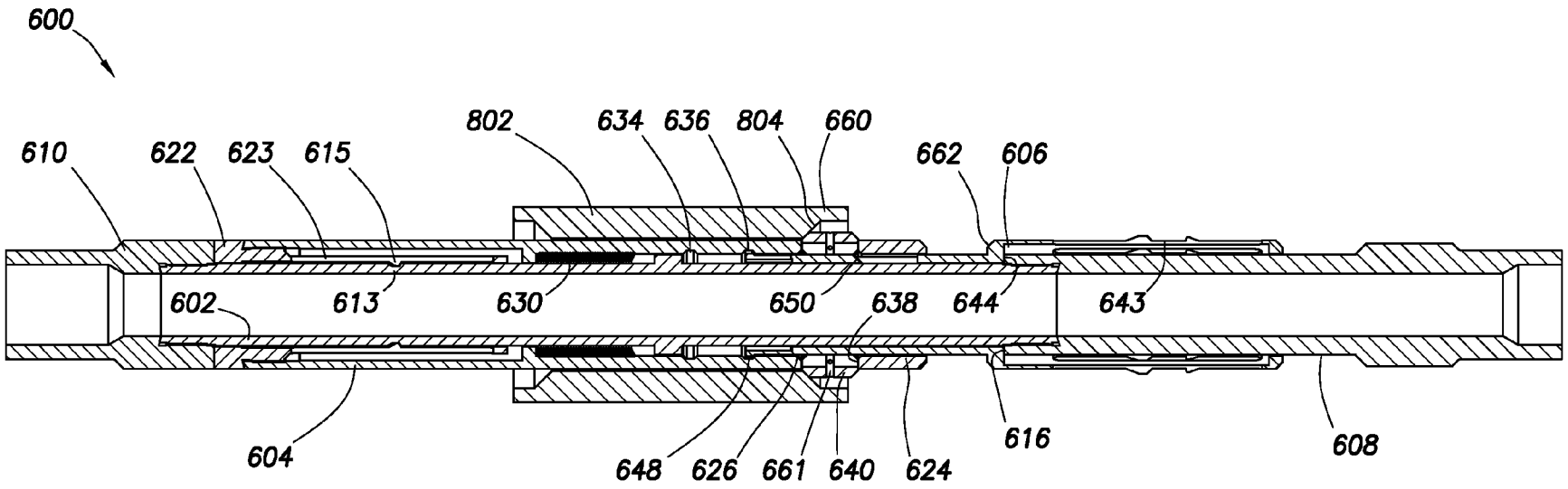
FIG. 8 is still another cross-sectional view of an embodiment of a weight down tool.

Once it is desired to convey the weight down tool 600 to another location in the wellbore, the weight down tool 600 may be reset by raising the weight down tool 600 through a restriction until the restriction engages the weight down lugs 640 and displaces them downwards a sufficient distance to reset the weight down tool 600. As shown in FIG. 8, the outer wellbore tubular 660 may comprise the reduced diameter portion 802, thereby forming the downwards facing shoulder 804. As the weight down tool 600 configured in the weight down configuration passes through the reduced diameter portion 802 in an upward direction, the weight down lugs 640 may engage with the downwards facing shoulder 804 to apply a downwardly directed longitudinal force to the weight down lugs 640, causing the upper housing 604 to move downwards with respect to the central mandrel 602. The movement of the upper housing 604 may be resisted due to the interaction of the collet lug 615 with the indicator 613. Upon the application of a threshold force, the collet lug 615 may expand the collet fingers 623 to allow the collet lug 615 to disengage from the collet indicator 613. The upper housing 604 may then move downwards with respect to the central mandrel 602, and the biasing member 630 may be compressed as the upper housing 604 moves downwards. As the upper housing 604 moves downwards, the weight down lugs 640 may align with the lug windows 650 in the first end 626 of the indicator sleeve 606, which may correspond to position at which the second end 624 of the upper housing 604 engages and/or is adjacent to the upward facing shoulder 662 formed on the indicator sleeve 606. Further the collet fingers 648 may disengage from the indicator 636 and move upwards into engagement with the first indicator 634 as the upper housing 604 moves downwards. Upon aligning the weight down lugs 640 with the lug windows 650, the one or more biasing members 661 may bias the weight down lugs 640 into the retracted position within the lug windows 650. Once the weight down lugs 640 are retracted, the upper housing 604 and the indicator sleeve 606 may be coupled by the weight down lugs 640 within the lug windows 650 of the indicator sleeve 606 and the weight down lug windows 638 of the upper housing 604. In this configuration, the weight down tool 600 may move upwards through the restriction 802.

When the weight down lugs 640 are in the retracted position, the compressed biasing member 630 may bias the upper housing upwards relative to the central mandrel 602. As the upper housing moves upwards, the indicator sleeve 606 may also move upwards relative to the central mandrel 602 due to the coupling between the upper housing 604 and the indicator sleeve 606 at the weight down lugs 640. When the upper housing moves upwards to the run-in position, the collet lug 615 on the collet fingers 623 may re-engage the indicator 613. Further, the indicator sleeve 606 may return to the run-in configuration by moving upwards relative to the central mandrel 602. In this configuration, the weight down tool 600 is re-set to the run-in configuration as shown in FIG. 6. In this configuration, the weight down tool 600 may then be retrieved from the wellbore, raised through one or more restrictions within the wellbore tubular 660, and/or lowered through one or more restrictions in the wellbore tubular 660 without returning to the weight down configuration. In order to return to the weight down configuration, the arming process described above can be repeated and weight placed on a suitable restriction.

In an embodiment, the weight down tool 600 may be used to applying weight to a restriction in a wellbore. For example an indicator disposed on an indicator sleeve may be engaged with a first restriction in a wellbore. The first restriction may comprise a profile corresponding to a keyed profile on the indicator, and the indicator may engage the first restriction when the keyed profile matches the corresponding profile on the restriction. Once the indicator is engaged with the first restriction, the central mandrel may be raised relative to the indicator sleeve, thereby expanding a plurality of weight down lugs into an expanded position. The plurality of weight down lugs may be lowered into engagement with the first restriction, and weight may be applied to the first restriction using the plurality of weight down lugs. In order to convey retrieve the weight down tool within the wellbore and/or retrieve the weight down tool from the wellbore, the plurality of weight down lugs may be raised into engagement with a second restriction above the first restriction. The weight down lugs may retract out of the expanded position in response to raising the plurality of weight down lugs into the second restriction.

The weight down tools described herein may be used as part of a wellbore tubular string in performing a workover, completion, and/or production operation in a multi-zone well. In an embodiment, a weight down tool comprising a central mandrel may be located within an outer wellbore tubular string, which may comprise a plurality of interior restrictions as described above with respect to FIG. 1. For example, the plurality of interior restrictions may comprise an upper restriction, and intermediate restriction, and a lower restriction. An outwardly extending indicator disposed about the central mandrel may be raised into at least one of the intermediate restriction or the lower restriction. In response to raising the indicator into the restriction, a plurality of weight down lugs may be expanded from a retracted position to an expanded position. The plurality of weight down lugs may then be engaged with the lower restriction to allow weight to be transferred from the central mandrel to the lower restriction using the plurality of weight down lugs. A first zone in the wellbore may then be treated in a workover, completion, and/or production operation when the weight down lugs are engaged with the lower restriction. Once the first zone is treated, the weight down tool may be reset to allow a second zone to be treated. For example, the weight down lugs may be engaged with the intermediate restriction. In response to engaging the weight down lugs with the intermediate restriction, the weight down lugs may be refracted from the expanded position to the retracted position. With the weight down lugs retracted, the indicator may be raised into at least one of the upper restriction or the intermediate restriction. As a result of raising the indicator into the at least one of the upper restriction or the intermediate restriction, the plurality of weight down lugs may be expanded from the retracted position to the expanded position. The weight down lugs may then engage the intermediate restriction, and weight may be transferred from the central mandrel to the intermediate restriction using the plurality of weight down lugs. The second zone may then be treated when the weight down lugs are engaged with the intermediate restriction. The weight down tool may then be reset, and the process repeated to treat a third zone. In an embodiment, this process may be repeated a plurality of times to treat a desired number of zones in the wellbore. Once all of the desired zones have been treated, the weight down tool may be retrieved from the wellbore.

While the weight down tool is described herein as being used to apply weight to a restriction in a downward direction, it will be appreciated that the tool may work in a hold down configuration by reversing the direction of the tool. For example, the tool may be used to support an upward force against the lower shoulder of a restriction by flipping the weight down tool described herein. The tool may then operate in a similar manner as described herein with the directions of each component and method reversed.

Having described the various tools, systems, and method herein, embodiments may include, but are not limited to:

In an embodiment, a weight down system comprises a wellbore comprising a plurality of restrictions; and a weight down tool. The weight down tool comprises a central mandrel configured to be coupled to a wellbore tubular; an outwardly extending indicator disposed about the central mandrel, wherein the indicator is configured to retract inwards in response to moving through one or more of the plurality of restrictions in a downwards direction; and a plurality of radially expandable weight down lugs configured to selectively transition between an expanded position and a refracted position. The indicator is configured to expand the weight down lugs into the expanded position in response to moving through one or more restrictions of the plurality of restrictions in an upwards direction, and the weight down lugs are configured to retract to the retracted position in response to the weight down lugs moving through one or more restrictions of the plurality of restrictions in an upwards direction. The weight down lugs may be configured to engage a restriction of the plurality of restrictions and prevent downwards movement of the central mandrel with respect to the restriction when the weight down lugs are disposed in the expanded position. The weight down lugs may be configured to remain out of engagement with the plurality of restrictions when the weight down lugs are in the retracted position. The indicator comprises a keyed profile, and at least one restriction of the plurality of restrictions comprises a profile configured to correspond to and engage the keyed profile. An engagement force above a threshold may be provided when the keyed profile is engaged with the profile on the at least one restriction, and the threshold may be greater than a force required to expand the weight down lugs into the expanded position. The weight down tool does not comprise a collet.

In an embodiment, a method of applying weight to a restriction in a wellbore comprises raising an outwardly extending indicator disposed about a central mandrel into a restriction, where the restriction is formed on an inner surface of an outer wellbore tubular; expanding a plurality of weight down lugs from a retracted position to an expanded position in response to raising the indicator into the restriction, where the plurality of weight down lugs are configured to support the central mandrel and resist an axially and upwards directed force on the weight down lugs when the weight down lugs are in the expanded position; transferring weight from the central mandrel to the outer wellbore tubular using the plurality of weight down lugs in the expanded position; applying an axially and downwardly directed force to the plurality of weight down lugs in the expanded position; translating the plurality of weight down lugs axially downwards in response to applying the axially and downwardly directed force; and retracting the weight down lugs from the expanded position to the retracted position in response to applying the axially and downwardly directed force to the plurality of weight down lugs, for example, when moving the central mandrel upwards. In an embodiment, transferring weight from the central mandrel to the outer wellbore tubular may comprise engaging the plurality of weight down lugs with the restriction. In some embodiments, transferring weight from the central mandrel to the outer wellbore tubular may comprise engaging the plurality of weight down lugs with a lower restriction, where the lower restriction may be below the restriction. Applying the axially and downwardly directed force to the plurality of weight down lugs may comprise raising the weight down lugs into engagement with the restriction, and raising the central mandrel relative to the weight down lugs when the weight down lugs engage the restriction. In some embodiments applying the axially and downwardly directed force to the plurality of weight down lugs may comprise raising the weight down lugs into engagement with an upper restriction, where the upper restriction is disposed above the restriction, and raising the central mandrel relative to the weight down lugs when the weight down lugs engage the restriction. Transferring weight from the central mandrel to the outer wellbore tubular may comprise: engaging the weight down lugs in the expanded position with a lower restriction, where the lower restriction is disposed below the restriction. In some embodiments, transferring weight from the central mandrel to the outer wellbore tubular may comprise: engaging the weight down lugs in the expanded position with the restriction. The method may also include performing one or more workover, completion, or production operations while transferring the weight from the central mandrel to the outer wellbore tubular using the plurality of weight down lugs in the expanded position. The indicator may comprise a keyed profile, and the restriction may comprise a profile corresponding to the keyed profile. Raising the indicator into the restriction may comprise engaging the keyed profile on the indicator with the profile on the restriction. The method may also include passing the central mandrel through a second restriction. The keyed profile may not correspond to the inner surface of the second restriction, and the indicator may not engage the second restriction.

In an embodiment, a method of treating multi-zone wellbore comprises locating a weight down tool comprising a central mandrel within an outer wellbore tubular string; where the outer wellbore tubular string comprises a plurality of interior restrictions, and the plurality of interior restrictions comprise an upper restriction, and intermediate restriction, and a lower restriction; raising an outwardly extending indicator disposed about the central mandrel into at least one of the intermediate restriction or the lower restriction; expanding a plurality of weight down lugs from a retracted position to an expanded position in response to raising the indicator; engaging the plurality of weight down lugs with the lower restriction; transferring weight from the central mandrel to the lower restriction using the plurality of weight down lugs; and treating a first zone in the wellbore when the weight down lugs are engaged with the lower restriction. The method may also include engaging the weight down lugs with the intermediate restriction; retracting the weight down lugs from the expanded position to the retracted position in response to engaging the weight down lugs with the intermediate restriction; raising the indicator into at least one of the upper restriction or the intermediate restriction; expanding the plurality of weight down lugs from the retracted position to the expanded position in response to raising the indicator into the at least one of the upper restriction or the intermediate restriction; engaging the plurality of weight down lugs with the intermediate restriction; transferring weight from the central mandrel to the intermediate restriction using the plurality of weight down lugs; treating a second zone in the wellbore when the weight down lugs are engaged with the intermediate restriction. Treating the first zone may comprise performing at least one of a gravel packing operation or a fracturing operation.

In an embodiment, a weight down tool comprises a central mandrel configured to be coupled to a wellbore tubular; a plurality of outwardly extending hunter lugs disposed about the central mandrel, wherein the hunter lugs are configured to retract in response to moving through an upper restriction in a downwards direction; and a plurality of radially expandable weight down lugs disposed about the central mandrel. The hunter lugs are configured to expand the weight down lugs into an expanded position in response to moving through the upper restriction in an upwards direction, and the weight down lugs are configured to retract out of the expanded position in response to moving through the upper restriction in an upwards direction. The plurality of weight down lugs may be retracted inwards in a run-in configuration of the weight down tool. The plurality of hunter lugs may be expanded outwards in the run-in configuration of the weight down tool. The plurality of weight down lugs may be configured to pass through the upper restriction without engaging the upper restriction in the run-in configuration. The plurality of weight down lugs may be in the expanded position in a weight down configuration of the weight down tool. The plurality of hunter lugs may be retracted inwards in the weight down configuration of the weight down tool. The plurality of weight down lugs may be configured to engage a lower shoulder and prevent downwards movement of the central mandrel with respect to the lower shoulder in the weight down configuration.

In an embodiment, a weight down tool comprises a central mandrel configured to be coupled to a wellbore tubular; a setting sleeve slidably disposed about the central mandrel, wherein the setting sleeve comprises a first end and a second end; a plurality of radially expandable hunter lugs retained by the setting sleeve; a weight down sleeve slidably disposed about the central mandrel; and a plurality of radially expandable weight down lugs retained by the weight down sleeve. The second end of the setting sleeve is configured to selectively shift into radial alignment with the weight down lugs and expand the weight down lugs into an expanded position in response to the plurality of hunter lugs moving upwards through a restriction, and the plurality of weight down lugs are configured to retract out of the expanded position in response to the plurality of weight down lugs moving through the restriction in an upwards direction. The weight down tool may also include a plurality of lockout lugs retained by the setting sleeve. The lockout lugs may be configured to engage a recess in the central mandrel and prevent axial translation of the setting sleeve when the second end of the setting sleeve is in radial alignment with the weight down lugs. The plurality of weight down lugs may be configured to engage a second restriction and prevent downward movement of the wellbore tubular relative to the second restriction when the weight down lugs are in the expanded position. The second restriction may be below the first restriction.

In an embodiment, a weight down system comprises a wellbore comprising an upper restriction and a lower restriction, and a weight down tool. The weight down tool comprises a central mandrel configured to be coupled to a wellbore tubular; an outwardly extending indicator disposed about the central mandrel; and one or more radially expandable weight down lugs configured to selectively transition between an expanded position and a retracted position. The indicator is configured to expand the one or more weight down lugs into the expanded position in response to moving through the upper restriction in an upwards direction, and the one or more weight down lugs are configured to engage the lower restriction in the expanded position. The lower restriction has a larger inner diameter than the upper restriction. The system may also include one or more sealing members associated with the wellbore tubular. The one or more sealing members may be configured to sealingly engage the upper restriction and/or have a smaller outer diameter than the inner diameter of the lower restriction. The inner diameter of the lower restriction may be larger than the outer diameter of the indicator. The one or more weight down lugs may be configured to pass through the upper restriction and the lower restriction without contacting the upper restriction or the lower restriction in the retracted position. The one or more weight down lugs may have a larger outer diameter than the indicator when the one or more weight down lugs are in the expanded position. The one or more weight down lugs may be configured to retract to the retracted position in response to the one or more weight down lugs moving through the upper restriction in an upwards direction.

In an embodiment, a method of applying weight to a restriction in a wellbore comprises raising a setting sleeve disposed about a central mandrel through an upper restriction in a wellbore; expanding a plurality of weight down lugs from a retracted position to an expanded position in response to raising the setting sleeve though the upper restriction, where the plurality of weight down lugs are disposed about the central mandrel; engaging the plurality of weight down lugs with a lower restriction in the wellbore; applying weight to the lower restriction using the plurality of weight down lugs; raising the setting sleeve through the upper restriction; raising the plurality of weight down lugs into the upper restriction; and retracting the weight down lugs out of the expanded position in response to raising the setting sleeve through the upper restriction and raising the plurality of weight down lugs into the upper restriction. The method may also include lowering the setting sleeve and the weigh down lugs through the upper restriction when the weight down lugs are in the retracted position, where the weight down lugs do not engage the upper restriction when the weight down lugs are in the retracted position. Expanding the plurality of weight down lugs may comprise translating a portion of the setting sleeve into radial alignment with the plurality of weight down lugs, and propping the weight down lugs in the expanded position with the portion of the setting sleeve. Raising the plurality of weight down lugs into the upper restriction may comprise engaging the weight down lugs in the expanded position with the upper restriction, and longitudinally displacing the weight down lugs downwards relative to the setting sleeve until the weight down lugs are out of radial alignment with the portion of the setting sleeve. A wellbore tubular may be coupled to the central mandrel, and applying weight to the lower restriction may comprise supporting the wellbore tubular coupled to the central mandrel using the weight down lugs. The method may also include conveying the central mandrel, the setting sleeve, and the weight down lugs through one or more additional restrictions without the weight down lugs engaging the one or more additional restrictions after retracting the weight down lugs out of the expanded position. The method may also include performing one or more workover, completion, or production operations while applying the weight to the lower restriction using the plurality of weight down lugs. Raising the plurality of weight down lugs into the upper restriction may comprise engaging the weight down lugs in the expanded position with the upper restriction, and longitudinally displacing the weight down lugs downwards relative to the central mandrel. The method may also include retrieving the central mandrel, the setting sleeve, and the weight down lugs from the wellbore after the retracting the weight down lugs out of the expanded position. The method may also include raising the setting sleeve through an third restriction in a wellbore; expanding the plurality of weight down lugs from the retracted position to the expanded position in response to raising the setting sleeve though the third restriction; engaging the plurality of weight down lugs with a fourth restriction in the wellbore, wherein the fourth restriction is below the third restriction; applying weight to the fourth restriction using the plurality of weight down lugs; raising the setting sleeve through the third restriction; raising the plurality of weight down lugs into the third restriction; and retracting the weight down lugs out of the expanded position in response to raising the setting sleeve through the third restriction and raising the plurality of weight down lugs into the third restriction.

In an embodiment, a weight down tool comprises a central mandrel configured to be coupled to a wellbore tubular; an outwardly extending indicator disposed about the central mandrel, wherein the indicator is configured to retract inwards in response to moving through an upper restriction in a downwards direction; and a plurality of radially expandable weight down lugs configured to engage a lower restriction and prevent downwards movement of the central mandrel with respect to the lower restriction when disposed in an expanded position. The indicator is configured to expand the weight down lugs into the expanded position in response to moving through the lower restriction in an upwards direction, and the weight down lugs are configured to retract out of the expanded position in response to moving through the upper restriction in an upwards direction. The indicator may comprise a keyed profile. The indicator may be a portion of a collet, and the indicator may be disposed on an outer surface of the collet. The lower restriction may comprise a profile configured to correspond to and engage the keyed profile. An engagement force above a threshold may be provided when the keyed profile is engaged with the corresponding profile on the lower restriction, and the threshold may be greater than the force required to expand the weight down lugs into the expanded position. The outer diameter of the weight down lugs may be less than the inner diameter of the upper restriction and the lower restriction when the weight down lugs are retracted inwards.

In an embodiment, a weight down tool comprises a central mandrel configured to be coupled to a wellbore tubular; an upper housing slidably disposed about the central mandrel; an indicator sleeve slidably disposed about the central mandrel; an outwardly extended and inwardly collapsible indicator disposed on the indicator sleeve; and a plurality of radially expandable weight down lugs retained by the upper housing. The indicator sleeve is configured to selectively expand the weight down lugs into an expanded position in response to the indicator moving upwards through a first restriction; and the plurality of weight down lugs are configured to retract out of the expanded position in response to the plurality of weight down lugs moving through a second restriction in an upwards direction, where the second restriction is above the first restriction. The weight down lugs may be configured to engage the first restriction and prevent downwards movement of the central mandrel with respect to the first restriction when disposed in an expanded position. The weight down tool may also include a collet body coupled to a first end of the upper housing. The collet body may comprise a collet finger configured to engage a collet indicator disposed on an outer surface of the central mandrel. A first end of the indicator sleeve may comprise lug windows configured to receiving the plurality of weight down lugs when the lug windows are in radial alignment with the plurality of weight down lugs. The weight down lugs may be configured to expand into the expanded position when the lug windows are longitudinally translated out of alignment with the weight down lugs. The indicator may comprise a keyed profile, and the keyed profile may be configured to engage a corresponding profile disposed on the first restriction.

In an embodiment, a method of applying weight to a restriction in a wellbore comprises engaging an indicator disposed on an indicator sleeve with a first restriction in a wellbore, wherein the indicator sleeve is disposed about a central mandrel; raising the central mandrel relative to the indicator sleeve; expanding a plurality of weight down lugs into an expanded position in response to raising the central mandrel relative to the indicator sleeve; lowering the plurality of weight down lugs into engagement with the first restriction; and applying weight to the first restriction using the plurality of weight down lugs. The indicator may comprise a keyed profile, and the first restriction may comprise a profile corresponding to the keyed profile. Engaging the indicator with the first restriction may comprise engaging the keyed profile on the indicator with the profile on the first restriction. Raising the central mandrel relative to the indicator sleeve may comprise retaining the indicator sleeve in position based on the engagement between the keyed profile on the indicator with the profile on the first restriction, and raising the central mandrel. A wellbore tubular string may be coupled to the central mandrel, and applying weight to the first restriction may comprise supporting the wellbore tubular string with the weight down lugs. The method may also include performing one or more workover, completion, or production operations while applying the weight to the first restriction using the plurality of weight down lugs. The method may also include raising the plurality of weight down lugs into a second restriction above the first restriction; and retracting the weight down lugs out of the expanded position in response to raising the plurality of weight down lugs into the second restriction. The method may also include engaging the indicator with a third restriction in the wellbore; raising the central mandrel relative to the indicator sleeve; expanding the plurality of weight down lugs into an expanded position in response to raising the central mandrel relative to the indicator sleeve; lowering the plurality of weight down lugs into engagement with the third restriction; and applying weight to the third restriction using the plurality of weight down lugs.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed:

1. A weight down tool comprising:

a central mandrel configured to be coupled to a wellbore tubular;

an outwardly extending indicator disposed about the central mandrel, wherein the indicator is configured to retract inwards in response to moving through an upper restriction in a downwards direction; and a plurality of radially expandable weight down lugs configured to engage a lower restriction and prevent downwards movement of the central mandrel with respect to the lower restriction when disposed in an expanded position, wherein the indicator is configured to expand the weight down lugs into the expanded position in response to moving through the lower restriction in an upwards direction, and wherein the weight down lugs retract out of the expanded position in response to moving through the upper restriction in an upwards direction.

2. The weight down tool of claim 1, wherein the indicator comprises a keyed profile.

3. The weight down tool of claim 2, wherein the indicator is a portion of a collet, and wherein the indicator is disposed on an outer surface of the collet.

4. The weight down tool of claim 2, wherein the lower restriction comprises a profile configured to correspond to and engage the keyed profile.

5. The weight down tool of claim 4, wherein an engagement force above a threshold is provided when the keyed profile is engaged with the corresponding profile on the lower restriction, and where the threshold is greater than the force required to expand the weight down lugs into the expanded position.

6. The weight down tool of claim 1, wherein the outer diameter of the weight down lugs is less than the inner diameter of the upper restriction and the lower restriction when the weight down lugs are retracted inwards.

7. A weight down tool comprising:

a central mandrel configured to be coupled to a wellbore tubular;

an upper housing slidably disposed about the central mandrel;

an indicator sleeve slidably disposed about the central mandrel;

an outwardly extended and inwardly collapsible indicator disposed on the indicator sleeve; and a plurality of radially expandable weight down lugs retained by the upper housing;

wherein the indicator sleeve is configured to selectively expand the weight down lugs into an expanded position in response to the indicator moving upwards through a first restriction;

and wherein the plurality of weight down lugs retract out of the expanded position in response to the plurality of weight down lugs moving through a second restriction in an upwards direction, wherein the second restriction is above the first restriction.

8. The weight down tool of claim 7, wherein the weight down lugs are configured to engage the first restriction and prevent downwards movement of the central mandrel with respect to the first restriction when disposed in an expanded position.

9. The weight down tool of claim 7, further comprising a collet body coupled to a first end of the upper housing, wherein the collet body comprises a collet finger configured to engage a collet indicator disposed on an outer surface of the central mandrel.

10. The weight down tool of claim 7, wherein a first end of the indicator sleeve comprises lug windows configured to receiving the plurality of weight down lugs when the lug windows are in radial alignment with the plurality of weight down lugs.

11. The weight down tool of claim 10, wherein the weight down lugs are configured to expand into the expanded position when the lug windows are longitudinally translated out of alignment with the weight down lugs.

12. The weight down tool of claim 7, wherein the indicator comprises a keyed profile, and wherein the keyed profile is configured to engage a corresponding profile disposed on the first restriction.

* * * * *